US009773380B2

(12) United States Patent
Arnone et al.

(10) Patent No.: US 9,773,380 B2
(45) **Date of Patent: *Sep. 26, 2017**

(54) MULTILAYER HYBRID GAMES

(71) Applicant: Gamblit Gaming, LLC, Glendale, CA (US)

(72) Inventors: Miles Arnone, Sherborn, MA (US); Caitlyn Ross, Watertown, MA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/091,395

(22) Filed: Apr. 5, 2016

(65) Prior Publication Data

US 2016/0232739 A1 Aug. 11, 2016

Related U.S. Application Data

(63) Continuation of application No. 14/018,315, filed on Sep. 4, 2013, now Pat. No. 9,336,656, which is a (Continued)

(51) Int. Cl.
*G07F 17/32* (2006.01)

(52) U.S. Cl.
CPC ..... *G07F 17/326* (2013.01); *G07F 17/32* (2013.01); *G07F 17/3244* (2013.01); *G07F 17/3272* (2013.01); *G07F 17/3288* (2013.01)

(58) Field of Classification Search
USPC ..... 463/25, 42
See application file for complete search history.

(56) References Cited

U.S. PATENT DOCUMENTS 5,413,357 A 5/1995 Schulze et al.
5,718,429 A 2/1998 Keller (Continued)

FOREIGN PATENT DOCUMENTS

JP 2001300098 A 10/2001
JP 2003111980 A 4/2003

(Continued)

OTHER PUBLICATIONS

ITL.NIST.GOV, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.

(Continued)

*Primary Examiner* — Tramar Harper
(74) *Attorney, Agent, or Firm* — Caitlyn Ross

(57) ABSTRACT

Systems and methods in accordance with embodiments of the invention operate a multilayer hybrid game with a real world engine connected by a communication link to a game world engine wherein the real world engine comprises a real world credit meter, a random number generator, and a real world credit pay table, wherein the real world engine is configured to receive from the game world engine via the communication link, a trigger of a wager of real world credit, determine a gambling outcome for the wager of real world credit in response to the trigger, and communicate to the game world engine via the communication link, the gambling outcome, allocate the randomly generated payout of real world credits to the credit meter, an entertainment software engine connected to the game world engine configured to execute a multilayer entertainment game that provides outcomes based upon a plurality of players' skillful (Continued)

execution of the multilayer entertainment game, wherein players at a same gameplay layer are engaged in gameplay subject to the same standards for gameplay progression and utilization of gameplay resources, and wherein impact of an action of a first player at a first gameplay layer on a second player's gameplay in a second gameplay layer are specified by at least one gameplay impact rule, receive input for a player's action during the multilayer entertainment game, communicate to the game world engine, the action taken by the player, generate a user interface display that depicts a representation of the multilayer entertainment game, a game world engine connected to the entertainment software engine and connected to the real world engine by the communication link wherein the game world engine is configured to monitor player actions for a gambling event occurrence where the gambling event occurrence triggers the wager of real world credits, communicate the trigger to the real world engine via the communication link, receive from the real world engine via the communication link, the gambling outcome, generate a multilayer entertainment game impact that can be used to modify the multilayer entertainment game gameplay based a plurality of players' skillful execution of the multilayer entertainment game and a sponsorship module constructed to: receive from the game world engine a sponsorship term; communicate to the player the sponsorship term through a user interface; receive from the user interface acceptance of the sponsorship term; send the command to execute the multilayer entertainment game based upon the sponsorship term.

11 Claims, 14 Drawing Sheets

Related U.S. Application Data continuation of application No. PCT/US2012/068273, filed on Dec. 6, 2012.

(60) Provisional application No. 61/630,203, filed on Dec. 6, 2011.

(56) References Cited

U.S. PATENT DOCUMENTS 5,785,592 A 7/1998 Jacobsen
5,853,324 A 12/1998 Kami et al.
5,963,745 A 10/1999 Collins et al.
6,050,895 A 4/2000 Luciano
6,165,071 A 12/2000 Weiss
6,227,974 B1 5/2001 Eilat
6,267,669 B1 7/2001 Luciano
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,430,735 B2 4/2013 Oberberger
8,475,266 B2 7/2013 Arnone
8,480,470 B2 7/2013 Napolitano et al.
8,622,809 B1 1/2014 Arora et al.
8,864,564 B2 10/2014 Oberberger
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0102238 A1 5/2004 Taylor
2004/0121839 A1 6/2004 Webb
2004/0224741 A1* 11/2004 Jen ..... A63F 13/10 463/6
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0246973 A1* 11/2006 Thomas ..... A63F 13/42 463/4
2006/0258433 A1 11/2006 Finocchio et al.

(56) References Cited

U.S. PATENT DOCUMENTS

2007/0015562 A1* 1/2007 Smith ..... A63F 1/00 463/13
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1* 7/2007 O'Rourke ..... G07F 17/32 463/42
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0265092 A1* 11/2007 Betteridge ..... G07F 17/32 463/42
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0026826 A1* 1/2008 Groswirt ..... G07F 17/32 463/25
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0305870 A1 12/2008 Henderson
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0221355 A1 9/2009 Dunaevsky et al.
2009/0239610 A1 9/2009 Olive
2009/0247272 A1 10/2009 Abe
2009/0270164 A1 10/2009 Seelig
2009/0275393 A1 11/2009 Kisenwether
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111837 A1 5/2011 Gagner
2011/0111841 A1 5/2011 Tessmer
2011/0118011 A1 5/2011 Filipour et al.
2011/0201413 A1 8/2011 Oberberger
2011/0207523 A1 8/2011 Filipour et al.
2011/0212766 A1 9/2011 Bowers et al.
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0108323 A1 5/2012 Kelly
2012/0135793 A1 5/2012 Antonopoulos
2012/0202587 A1 8/2012 Allen
2012/0302311 A1 11/2012 Luciano
2012/0322545 A1 12/2012 Arnone et al.
2013/0029760 A1 1/2013 Wickett
2013/0131848 A1 5/2013 Arnone et al.
2013/0190074 A1 7/2013 Arnone et al.
2013/0260869 A1 10/2013 Basallo et al.
2014/0087801 A1 3/2014 Nicely et al.
2014/0087808 A1 3/2014 Basallo et al.

(56) References Cited

U.S. PATENT DOCUMENTS

| | | | |
|---|---|---|---|
| 2014/0087809 | A1 | 3/2014 | Leupp et al. |
| 2014/0357350 | A1 | 12/2014 | Weingardt et al. |

FOREIGN PATENT DOCUMENTS

| | | | | |
|---|---|---|---|---|
| JP | 2004097610 | A | 4/2004 | |
| JP | 2004166746 | A | 6/2004 | |
| JP | 2004261202 | A | 9/2004 | |
| WO | 9851384 | A1 | 11/1998 | |
| WO | 2010087090 | A1 | 8/2010 | |
| WO | 2011109454 | A1 | 9/2011 | |
| WO | WO2011109454 | A1 * | 9/2011 | ..... A63F 13/00 |
| WO | 2012139083 | A1 | 10/2012 | |

OTHER PUBLICATIONS

Changing the Virtual Self: Avatar Transformations in Popular Games; Barr et al., Victoria Univ., NZ, 2006.
Real-Time Multimodal Human—Avatar Interaction; Li et al., IEEE (Video Technology) vol. 18, No. 4, 2008.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
WIPO—ISA, International Search Report and Written Opinion, PCT/US2012/68273, May 13, 2013.
U.S. Appl. No. 14/205,303 Arnone, et al., filed Mar. 11, 2014.
U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.
U.S. Appl. No. 14/188,587 Arnone, et al., filed Feb. 24, 2014.
U.S. Appl. No. 15/063,365 Arnone, et al. filed Mar. 7, 2016.
U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.

(56) References Cited

OTHER PUBLICATIONS

U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 14/799,481 Arnone, et al. filed Jul. 14, 2015.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 28, 2015.
U.S. Appl. No. 14/868,287 Arnone, et al. filed Sep. 28, 2015.
U.S. Appl. No. 14/868,364 Arnone, et al. filed Sep. 28, 2015.
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.
U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 14/984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.
Japan Patent Office, First Office Action, Japan Patent Application No. 2014-546085, dated Oct. 6, 2015, Japan.
IP Australia, Patent Examination Report No. 1, Patent Application No. 2012347769, dated Jul. 22, 2014.

* cited by examiner

MULTILAYER HYBRID GAMES

CROSS REFERENCE TO RELATED APPLICATIONS

This application is a continuation of U.S. patent application Ser. No. 14/135,562, filed on Dec. 19, 2013, which is a continuation of Patent Cooperation Treaty Application No. PCT/US12/68273, filed on Dec. 6, 2012, which claims the benefit of U.S. Provisional Patent Application No. 61/630,203 filed on Dec. 6, 2011 and is related to Patent Cooperation Treaty Application No. PCT/US11/26768, filed on Mar. 1, 2011, Patent Cooperation Treaty Application No. PCT/US11/63587, filed on Dec. 6, 2011, and Patent Cooperation Treaty Application No. PCT/US12/58156, filed on Sep. 29, 2012, the contents of each of which are hereby incorporated by reference in its entirety as if stated in full herein.

FIELD OF THE INVENTION

Embodiments of the present invention are generally related to gaming and more specifically to a multilayer hybrid game that includes both an entertainment game and a gambling game capable of coordinating gameplay across players in different gameplay layers.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game may depend upon a player's skill with the game. Gambling games are typically not as interactive and do not include graphics as sophisticated as an entertainment game, which is a game of skill such as a video game.

SUMMARY OF THE INVENTION

Systems and methods in accordance with embodiments of the invention operate a multilayer hybrid game. One embodiment includes a multilayer hybrid game, including: a real world engine constructed to provide a randomly generated payout of real world credits from at least one wager in a gambling game; an entertainment software engine constructed to execute a multilayer entertainment game providing outcomes based upon a player's skillful execution of the multilayer entertainment game to earn a payout of game world credits at a plurality of gameplay layers, where: players at a same gameplay layer are engaged in gameplay subject to the same standards for gameplay progression and utilization of gameplay resources; and impact of player actions at one gameplay layer on gameplay in another gameplay layer are specified by at least one gameplay impact rule; and a game world engine constructed to manage the entertainment software engine and communicate gameplay gambling event occurrences based upon a player's skillful execution of the multilayer entertainment game that trigger at least one wager in the gambling game to the gambling game; where the game world engine utilizes a multilayer module constructed to: detect at least one player action responsive to gameplay within a first gameplay layer of the plurality of gameplay layers; determine a gameplay impact for at least one player at a second gameplay layer in response to the detection of the at least one player action based upon the at least one gameplay impact rule; and apply the gameplay impact to the gameplay of at least one player at the second gameplay layer in accordance with the at least one gameplay impact rule.

In a further embodiment, the multilayer module is constructed to identify the at least one player at the second gameplay layer to which the gameplay impact is applied in accordance with the at least one gameplay impact rule based upon the at least one player belonging to a player class identified in the at least one gameplay impact rule.

In another embodiment, at least one player action is an action performed by a player within the first player's gameplay environment.

In a still further embodiment, at least one player action is an action applied to a first player within the first player's gameplay environment.

In still another embodiment, the at least one gameplay impact rule includes a gameplay impact rule that governs a gameplay impact triggered by a sequence of player actions.

In a yet further embodiment, the at least one gameplay impact rule includes a gameplay impact rule that is a reallocation of gameplay resources selected from the group consisting of real world credits and game world credits.

In yet another embodiment, the at least one gameplay impact rule includes a gameplay impact rule that is a reallocation of elements that are of limited quantity and the consumption of which during play of the entertainment game triggers a wager in a gambling game.

In a further embodiment again, the gameplay impact affects a player class at a lower level gameplay layer relative to the gameplay layer of the first player, where a lower level gameplay layer is a gameplay layer that supports a greater number of players relative to the number of players supported within the gameplay layer of the first player.

In another embodiment again, the gameplay impact affects a player class at a higher level gameplay layer relative to the gameplay layer of the first player, where a higher level gameplay layer is a gameplay layer that supports a lower number of players relative to the number of players supported within the gameplay layer of the first player.

In a further additional embodiment, the multilayer module is constructed to execute on the game world engine.

In another additional embodiment, the multilayer module is constructed to execute on a multilayer server and communicate with the game world engine via a network.

A still yet further embodiment includes a method of operating a multilayer hybrid game, the method including: detecting at least one player action responsive to gameplay within a first gameplay layer of a plurality of gameplay layers within a multilayer entertainment game of the multilayer hybrid game using a multilayer module utilized by a game world engine, where: the game world engine is constructed to communicate gameplay gambling event occurrences based upon a player's skillful execution of the multilayer entertainment game to earn a payout of gameplay resources in the form of game world credits as detected by an entertainment software engine that triggers at least one wager in a gambling game to the gambling game including a real world engine constructed to provide at least one wager as a randomly generated payout of gameplay resources in the form of real world credits for the gambling game; and players at a same gameplay layer are engaged in gameplay subject to the same standards for gameplay progression and utilization of gameplay resources; determining a gameplay impact for at least one player at a second gameplay layer in response to the detection of the at least one player action based upon at least one gameplay impact rule using the multilayer module, where: impact of player actions at one gameplay layer on gameplay in another gameplay layer are specified by at least one gameplay impact rule; and applying the gameplay impact to the gameplay of at least one player at the second gameplay layer in accordance with the at least one gameplay impact rule using the multilayer module.

In still yet another embodiment, the multilayer module is constructed to identify the at least one player at the second gameplay layer to which the gameplay impact is applied in accordance with the at least one gameplay impact rule based upon the at least one player belonging to a player class identified in the at least one gameplay impact rule.

In a still further embodiment again, at least one player action is an action performed by a player within the first player's gameplay environment.

In still another embodiment again, at least one player action is an action applied to a first player within the first player's gameplay environment.

In a still further additional embodiment, the at least one gameplay impact rule includes a gameplay impact rule that governs a gameplay impact triggered by a sequence of player actions.

In still another additional embodiment, the at least one gameplay impact rule includes a gameplay impact rule that is a reallocation of gameplay resources selected from the group consisting of real world credits and game world credits.

In a yet further embodiment again, the at least one gameplay impact rule includes a gameplay impact rule that is a reallocation of elements that are of limited quantity and the consumption of which during play of the entertainment game triggers a wager in a gambling game.

In yet another embodiment again, the gameplay impact affects a player class at a lower level gameplay layer relative to the gameplay layer of the first player, where a lower level gameplay layer is a gameplay layer that supports a greater number of players relative to the number of players supported within the gameplay layer of the first player.

A yet further additional embodiment includes a machine readable medium containing processor instructions, where execution of the instructions by a processor causes the processor to perform a process including: detecting at least one player action responsive to gameplay within a first gameplay layer of a plurality of gameplay layers within a multilayer entertainment game of a multilayer hybrid game, using a multilayer module utilized by a game world engine, where: the game world engine is constructed to communicate gameplay gambling event occurrences based upon a player's skillful execution of the multilayer entertainment game to earn a payout of gameplay resources in the form of game world credits as detected by an entertainment software engine that triggers at least one wager in a gambling game to the gambling game including a real world engine constructed to provide at least one wager as a randomly generated payout of gameplay resources in the form of real world credits for the gambling game; and players at a same gameplay layer are engaged in gameplay subject to the same standards for gameplay progression and utilization of gameplay resources; determining a gameplay impact for at least one player at a second gameplay layer in response to the detection of the at least one player action based upon at least one gameplay impact rule using the multilayer module, where: impact of player actions at one gameplay layer on gameplay in another gameplay layer are specified by at least one gameplay impact rule; and applying the gameplay impact to the gameplay of at least one player at the second gameplay layer in accordance with the at least one gameplay impact rule using the multilayer module.

DETAILED DESCRIPTION

Figure 1:
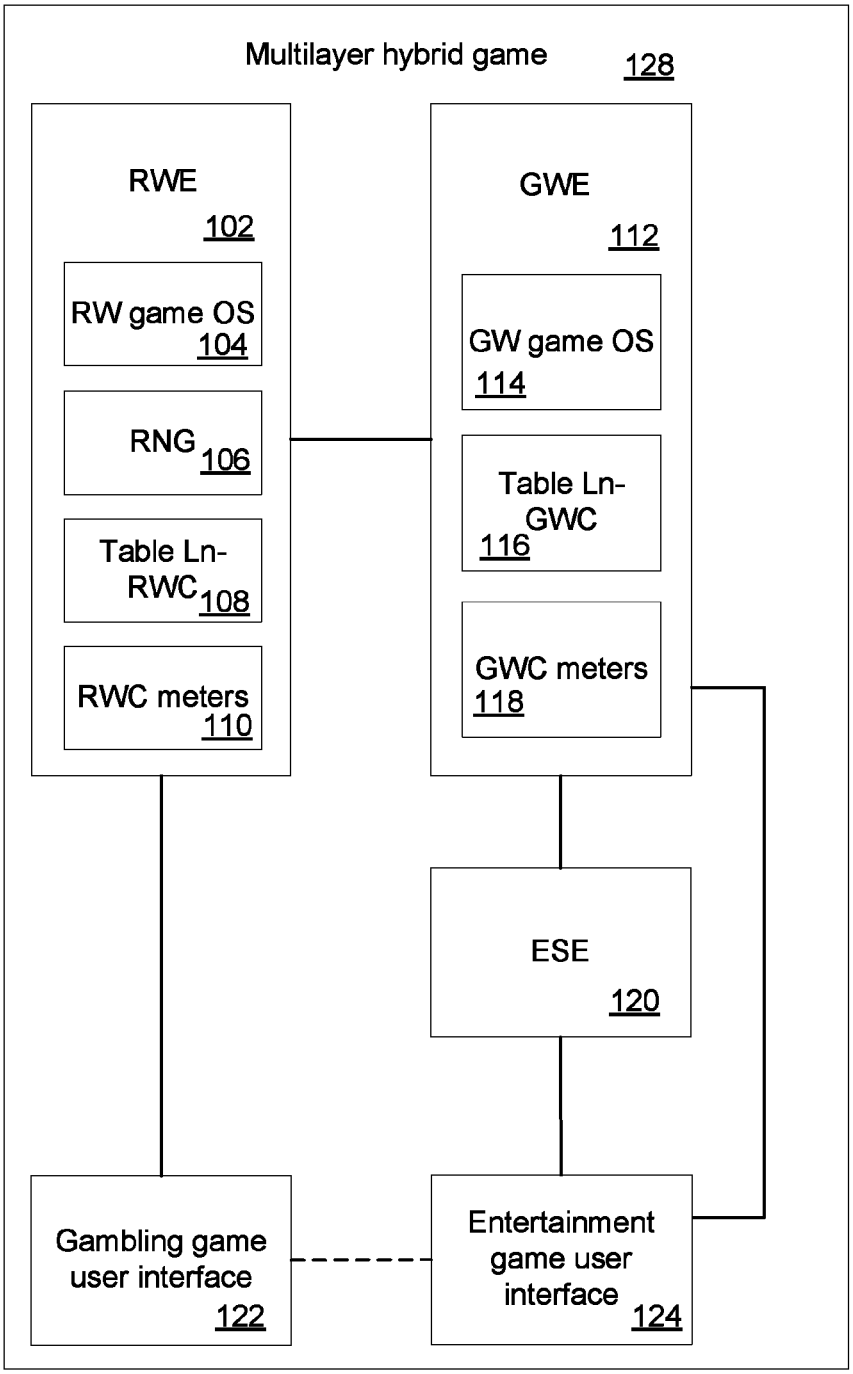
FIG. 1 illustrates a multilayer hybrid game in accordance with an embodiment of the invention.

Turning now to the drawings, systems and methods for operation of a multilayer hybrid game are illustrated. In several embodiments, a multilayer hybrid game is a form of a hybrid game that integrates a multilayer module with both a gambling game that includes a real world engine (RWE) which manages the gambling game, as well as an entertainment game that includes a game world engine (GWE) which manages the entertainment portion of a game, and an entertainment software engine (ESE) which executes the entertainment game for user entertainment. In certain embodiments, the multilayer hybrid game also includes a user interface associated with either or both the gambling game and the entertainment game. In operation of a multilayer hybrid game, a player acts upon various types of elements of the entertainment game in a game world environment. Upon acting on some of these elements, a wager is triggered in the gambling game. In playing the entertainment game, using the elements, a player can consume and accrue game world credits (GWC) within the entertainment game. These credits can be in the form of (but are not limited to) game world objects, experience points, or points generally. Wagers are made in the gambling game using real world credits (RWC). The real world credits can be credits in an actual currency, or may be credits in a virtual currency which has real world value. Gambling outcomes from the gambling game may cause consumption, loss or accrual of RWC. In addition, gambling outcomes in the gambling game may influence elements in the entertainment game such as (but not limited to) by restoring a consumed element, causing the loss of an element, restoration or placement of a fixed element. Example elements include enabling elements (EE) which are elements that enable a player's play of the entertainment game and whose consumption by the player while playing the entertainment game may trigger a wager in a gambling game. In addition, EE may also be replenished during play within the entertainment game based on an outcome of a triggered wager. Other types of elements include actionable elements (AE) which are elements that are acted upon to trigger a wager in the gambling game and may not be restorable during normal play of the entertainment game. Various hybrid games are discussed in Patent Cooperation Treaty Application No. PCT/US11/26768, filed Mar. 1, 2011, entitled "ENRICHED GAME PLAY ENVIRONMENT (SINGLE and/or MULTIPLAYER) FOR CASINO APPLICATIONS" and Patent Cooperation Treaty Application No. PCT/US11/63587, filed Dec. 6, 2011, entitled "ENHANCED SLOT-MACHINE FOR CASINO APPLICATIONS" each disclosure of which is hereby incorporated by reference in its entirety.

In many embodiments, a multilayer hybrid game is a hybrid game with a multilayer module that utilizes multiple types of gameplay, termed as gameplay layers, in a single gameplay session. Actions associated with a player in a multilayer hybrid game at one gameplay layer can impact the gameplay experienced by other players at different gameplay layers. A multilayer hybrid game can be used to generate a rich multiplayer gameplay experience, such as (but not limited to) a war type of multilayer hybrid game where a number of players can participate in a gameplay layer as leaders of various nations while other players participate in a different gameplay layer as military commanders under the president while yet other players participate in yet another gameplay layer as rank and file soldiers under the military commanders. As is discussed further below, any of a variety of different multilayer hybrid game scenarios can be utilized including (but not limited) war themed multilayer hybrid games, sports themed multilayer hybrid games, and racing themed multilayer hybrid games.

In a number of embodiments, gameplay layers are coordinated in a single gameplay session by applying the gameplay impact of player actions to the gameplay of player classes on various gameplay layers using a multilayer module. Gameplay impact can be any effect on gameplay such as but not limited to a reduction or increase in gameplay resources available to players, a reduction or increase in the rate of consumption of gameplay resources available to players, the addition or reduction of players in a gameplay session or revealing sections of a map used in gameplay. Gameplay resources can be any resource utilized to advance gameplay such as but not limited to RWC, GWC, EE, or AE. Gameplay impact can be applied according to gameplay impact rules which can be used to analyze a player action to determine the gameplay impact generated and how the gameplay impact is to be applied. A gameplay layer subjects the players within the gameplay layer to the same type of gameplay with the same standards for gameplay progression and utilization of gameplay resources. A multilayer hybrid game can have each gameplay layer subject to different standards for gameplay progression and utilization of gameplay resources or for multiple gameplay layers to share the same standards for gameplay progression and utilization of gameplay resources.

In many embodiments, a player action from a player in one gameplay layer can generate a gameplay impact that is applied to players at different gameplay layers. In several embodiments, a player can be part of a player class where each player within the player class receives the same gameplay impact in response to specific player actions of players in different gameplay layers. Each gameplay layer can include at least one player class. A player action can be any type of action within a multilayer hybrid game ascribed within gameplay to a human player from a user interface associated with a human player or ascribed within gameplay to a computer player generated automatically from information in a computer player profile stored within the multilayer hybrid game. A player action can be an action in gameplay performed by a player (such as but not limited to executing a shot that kills an opponent in a shooting type of entertainment game) or an action in gameplay that affects the player (such as but not limited to receiving a shot that kills the player in a shooting type of entertainment game). Player actions can produce a gameplay impact not only on the gameplay of the player making the action, but also on the gameplay of each player in a player class of a different gameplay layer by utilizing the multilayer module.

In numerous embodiments, the gameplay impact from player actions of individual players can ripple through a multilayer hybrid game by impacting the gameplay of players in different player classes at different gameplay layers. The gameplay impact of player actions can be applied in real time or can be turn based. In certain embodiments, multilayer hybrid games can facilitate gameplay where players at higher level gameplay layers each produce a gameplay impact from their player actions that is applied to the gameplay of players in player classes at lower level gameplay layers. The player actions of players at higher level gameplay layers can each produce a gameplay impact that is applied to the gameplay of players in a player class at a lower level gameplay layer sequentially by directly affecting players at a gameplay layer one level lower or non-sequentially by directly affecting players at a gameplay layer more than one level lower than the level of the gameplay layer of the player generating the player action. In particular embodiments, multilayer hybrid games can also facilitate gameplay where the gameplay impact of player action of players in a gameplay layer can be applied to players in classes on a different gameplay layer without regard to the level of the different gameplay layer. Additionally, a gameplay impact from player actions can be applied to players in a single class or multiple classes simultaneously.

In many embodiments, a multilayer hybrid game utilizes a multilayer module to apply a gameplay impact generated from a player action in one gameplay layer to players at different gameplay layers. In numerous embodiments, a multilayer module detects at least one player action, analyze the at least one player action for a gameplay impact and apply the gameplay impact to the gameplay of players at different gameplay layers in the multilayer hybrid game in accordance with the gameplay impact. The players at different gameplay layers can be part of a player class at the different gameplay layers. In numerous embodiments, a multilayer module can be implemented locally on a multilayer hybrid game within the GWE, remotely on a multilayer server accessible to a multilayer hybrid game via a network or as a distributed system where processes of a multilayer module occur locally on a multilayer hybrid game and on a remote server.

In several embodiments, a multilayer module can access a database containing various gameplay impact rules and/or information required to maintain various gameplay layers. A multilayer module can utilize the database to store and retrieve information related to players and/or player classes engaged in gameplay within a specific gameplay layer. In certain embodiments, the GWE can track the players and/or player classes engaged in gameplay within a specific gameplay layer with the multilayer module managing the generation and application of gameplay impact with information concerning players and/or player classes provided to the multilayer module by the GWE.

Multilayer hybrid games in accordance with embodiments of the invention are discussed below.

Multilayer Hybrid Games

In many embodiments, a multilayer hybrid game integrates high levels of entertainment content with a game of skill (entertainment game), a gambling experience with a game of chance (gambling game). A multilayer hybrid game provides for random outcomes independent of player skill while providing that the user's gaming experience (as measured by obstacles/challenges encountered, time of play and other factors) is shaped by the player's skill. A multilayer hybrid game in accordance with an embodiment of the invention is illustrated in FIG. 1. The multilayer hybrid game 128 includes a RWE 102, GWE 112, ESE 120, gambling game user interface 122 and entertainment game user interface 124. The two user interfaces may be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In several embodiments, the RWE 102 is the operating system for the gambling game of the skill calibrated hybrid game 128 and controls and operates the gambling game. The operation of a gambling game is enabled by RWC, such as money or other real world funds. A gambling game can increase or decreases an amount of RWC based on random gambling outcomes, where the gambling proposition of a gambling game is typically regulated by gaming control bodies. In many embodiments, the RWE includes a RW operating system (OS) 104, random number generator (RNG) 106, level "n" real-world credit pay tables (Table Ln-RWC) 108, RWC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithms and/or processes, which are used to generate random outcomes. A level "n" real-world credit pay table (Table Ln-RWC) 108 is a table that can be used in conjunction with a random number generator (RNG) 106 to dictate the real world credits (RWC) earned as a function of sponsored gameplay and is analogous to the pay tables used in a conventional slot machine. Table Ln-RWC payouts are independent of player skill. There may be one or a plurality of Table Ln-RWC pay tables 108 contained in a gambling game, the selection of which may be determined by factors including (but not limited to) game progress a player has earned, and/or bonus rounds which a player may be eligible for. Real world credits (RWC) are credits analogous to slot machine game credits, which are entered into a gambling game by the user, either in the form of money such as hard currency or electronic funds. RWCs can be decremented or augmented based on the outcome of a random number generator according to the Table Ln-RWC real world credits pay table 108, independent of player skill. In certain embodiments, an amount of RWC can be required to enter higher ESE game levels. RWC can be carried forward to higher game levels or paid out if a cash out is opted for by a player. The amount of RWC required to enter a specific level of the game "level n" need not be the same for each level.

In many embodiments, the GWE 112 manages the overall multilayer hybrid game operation, with the RWE 102 and the ESE 120 effectively being support units to the GWE 112. In several embodiments, the GWE 112 contains mechanical, electronic and software system for an entertainment game. The GWE 112 includes a GW game operating system (OS) 114 that provides control of the entertainment game. The GWE additionally contains a level "n" game world credit pay table (Table Ln-GWC) 116 from where to take input from this table to affect the play of the entertainment game. The GWE 112 can further couple to the RWE 102 to determine the amount of RWC available on the game and other metrics of wagering on the gambling game (and potentially affect the amount of RWC in play on the RWE). The GWE additionally contains various audit logs and activity meters (such as the GWC meter) 118. The GWE 112 can also couple to a centralized server for exchanging various data related to the player and their activities on the game. The GWE 112 furthermore couples to the ESE 120. The GWE can also utilize a multilayer module to apply a gameplay impact generated from a player action in one gameplay layer to players at different gameplay layers. In numerous embodiments, a GWE can utilize a multilayer module to detect at least one player action, analyze the at least one player action for a gameplay impact and apply the gameplay impact to the gameplay of players at different gameplay layers in the multilayer hybrid game in accordance with the gameplay impact. The players at different gameplay layers can be part of a player class at the different gameplay layers.

In many embodiments, a level "n" game world credit pay table (Table Ln-GWC) 116 dictates the GWC earned as a function of player skill in the nth level of the game. The payouts governed by this table are dependent upon player skill and sponsored gameplay at large and may or may not be coupled to a random number generator. In several embodiments, game world credits (GWC) are player points earned or depleted as a function of player skill, i.e. as a function of player performance in the context of the game. GWC is analogous to the "score" in a typical video game. Each entertainment game has one or more scoring criterion, embedded within the Table Ln-GWC 116 that reflects player performance against the goal(s) of the game. GWC can be carried forward from one level of sponsored gameplay to another, and ultimately paid out in various manners such as directly in cash, or indirectly such as earning entrance into a sweepstakes drawing, or earning participation in, or victory in, a tournament with prizes. GWC may be stored on a player tracking card or in a network-based player tracking system, where the GWC is attributed to a specific player.

In certain embodiments, the operation of the GWE does not affect the RWE's gambling operation except for player choice parameters that are allowable in slot machines today including but not limited to the wager amount, how fast the player wants to play (by pressing a button or pulling the slot's handle) and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RWC available in the gambling game. The communication link can also convey a necessary status operation of the RWE (such as on-line or tilt). The communication link can further communicate the various gambling control factors which the RWE 102 uses as input, such as the number of RWC consumed per game or the player's election to enter a jackpot round. In FIG. 1, the GWE 112 is also shown as connecting to the player's user interface directly, as this may be necessary to communicate certain entertainment game club points, player status, control the selection of choices and messages which a player may find useful in order to adjust their entertainment game experience or understand their gambling status in the RWE 102.

In various embodiments, the ESE 120 manages and controls the visual, audio, and player control for the entertainment game. In certain embodiments, the ESE 120 accepts input from a player through a set of hand controls, and/or head, gesture, and/or eye tracking systems and outputs video, audio and/or other sensory output to a user interface. In many embodiments, the ESE 120 can exchange data with and accept control information from the GWE 112. In several embodiments an ESE 120 can be implemented using a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In numerous embodiments, an ESE can be an electromechanical game system of a multilayer hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 may send certain GW game control parameters and elements to the ESE 120 to affect its play, such as (but not limited to) what level of character to be using, changing the difficulty level of the game, changing the type of gun or car in use, and/or requesting portions to become available or to be found by the character. These game control parameters and elements may be based on a gambling outcome of a gambling game that was triggered by an element in the entertainment game being acted upon by the player. The ESE 120 can accept this input from the GWE 112, make adjustments, and continue the play action all the while running seamlessly from the player's perspective. The ESE's operation is mostly skill based, except for where the ESE's processes may inject complexities into the game by chance in its normal operation to create unpredictability in the entertainment game. Utilizing this interface, the ESE 120 may also communicate player choices made in the game to the GWE 112, such as but not limited to selection of a different gun, and/or the player picking up a special portion in the GW environment. The GWE's job in this architecture, being interfaced thusly to the ESE 120, is to allow the transparent coupling of entertainment software to a fair and transparent random chance gambling game, providing a seamless perspective to the player that they are playing a typical popular entertainment game (which is skill based). In certain embodiments, the ESE 120 can be used to enable a wide range of entertainment games at different gameplay layers interconnected during a gameplay session with gameplay impact from player actions at one gameplay layer applied to gameplay at another gameplay layer including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In several embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RWC in play, and amount of RWC available. The RWE 102 can accept modifications in the amount of RWC wagered on each individual gambling try, or the number of games per minute the RWE 102 can execute, entrance into a bonus round, and other factors, all the while these factors can take a different form than that of a typical slot machine. An example of a varying wager amount that the player can choose might be that they have decided to play with a more powerful character in the game, a more powerful gun, or a better car. These choices can increase or decrease the amount wagered per individual gambling game, in the same manner that a standard slot machine player may decide to wager more or less credits for each pull of the handle. In several embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the hybrid game. In a particular embodiment, the RWE 102 operation can be a game of chance as a gambling game running every 10 seconds where the amount wagered is communicated from the GWE 112 as a function of choices the player makes in the operation profile in the entertainment game such as those cited above.

In many embodiments, a multilayer hybrid game integrates a video game style gambling machine, where the gambling game (i.e. RWE 102 and RWC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time a rich environment of rewards to stimulate "gamers" can be established with the entertainment game. In several embodiments, the multilayer hybrid game can leverage very popular titles with "garners" and provides a sea change environment for casinos to attract players with games that are more akin to the type of entertainment that a younger generation desires. In various embodiments, players can use their skill towards building and banking GWC that in turn can be used to win tournaments and various prizes as a function of their "gamer" prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In certain embodiments, multilayer hybrid games also allow players to gain entry into subsequent competitions through the accumulation of game world credits (GWC) that accrue as a function of the user's demonstrated skill at the game. These competitions can pit individual players or groups of players against one another and/or against the casino to win prizes based upon a combination of chance and skill. These competitions may be either asynchronous events, whereby players participate at a time and/or place of their choosing, or they may be synchronized events, whereby players participate at a specific time and/or venue.

In many embodiments, one or more players engage in playing an entertainment game, resident in the ESE, the outcomes of which are dependent at least in part on skill. The multilayer hybrid game can include an entertainment game that includes head-to-head play between a single player and the computer, between two or more players against one another, or multiple players playing against the computer and/or each other, as well as the process by which players bet on the outcome of the entertainment game.

In many embodiments, if an entertainment game includes a version of Madden Football™ a player can bet on whether or not the player is going to beat the computer, or if the player is playing against another player, that other player. These bets can be made, for example, on the final outcome of the game, and/or the state of the game along various intermediary points (such as but not limited to the score at the end of the 1st quarter) and/or on various measures associated with the game (such as but not limited to the total offensive yards, number of turnovers, or number of sacks). Players can bet against one another, or engage the computer in a head-to-head competition in the context of their skill level in the entertainment game in question. As such, players can have a handicap associated with their player profile that describes their skill (which can be their "professed skill" in certain embodiments), and which is used by a GWE (such as a local GWE or a GWE that receives services from remote servers) to offer appropriate bets around the final and/or intermediate outcomes of the entertainment game, and/or to condition sponsored gameplay as a function of player skill, and/or to select players across one or more multilayer hybrid games to participate in head to head games and/or tournaments.

Many embodiments enable the maximization of the number of players able to compete competitively by utilizing a skill normalization module. Handicapping enables players of varying performance potential to compete competitively regardless of absolute skill level, such as but not limited to where a player whose skill level identifies the player as a beginner can compete in head-to-head or tournament play against a highly skilled player with meaningful results.

In several embodiments, wagers can be made among numerous multilayer hybrid games with a global betting manager (GBM). The GBM is a system that coordinates wagers that are made across multiple multilayer hybrid games by multiple players. In some implementations it can also support wagers by third parties relative to the in game performance of other players. The GBM can stand alone, or is capable of being embedded in one of a number of systems, including a GWE, ESE or any remote server capable of providing services to a multilayer hybrid game, or can operate independently on one or a number of servers on-site at a casino, as part of a larger network and/or the internet or "cloud" in general. The GBM also supports the management of lottery tickets issued as a function of sponsored gameplay.

In many embodiments, third parties that are not playing a hybrid game can sponsor, wager and/or view play of a multilayer hybrid game. These third parties can include but are not limited to sponsors of multilayer hybrid gameplay and third parties that wager on aspects or outcomes of multilayer hybrid gameplay. A third party can sponsor or wager on any aspect of multilayer hybrid gameplay, including but not limited to sponsoring specific players, play amongst particular players, sponsored gameplay sessions, or multilayer hybrid games themselves. A GWE may relay information to a non-player interface for third parties to gather information concerning multilayer entertainment game play. In embodiments where the multilayer entertainment game includes a gameplay layer that is a fighting game, third parties may want to witness the movements of the game characters rather than simply the outcome of a fight at that gameplay layer. Therefore, the GWE can transmit information not only to the entertainment game user interface, but also to a non-player interface.

In various embodiments, a third party can see only select information about the gameplay and players on a non-player interface. This information can include (but is not limited to) EE values, GWC, RW wagers, sponsorship terms, information derived from sponsorable player profiles or any other information that can be transmitted to the GW user interface. For instance, the entertainment gameplay information may be visible to third parties on a non-player interface, but not information concerning the wagers a player is making in a gambling game of the multilayer hybrid game. Alternatively, in a shooter game gameplay layer of a multilayer hybrid game, the third parties may be able to see how much health each player has remaining, but has no information about how much ammunition each player has remaining.

In a number of embodiments, a non-player interface can include information that is not directly related to the multilayer entertainment game play of a particular multilayer hybrid game. This information can include, but is not limited to, the number of players betting on the multilayer entertainment game play, side-bets available, or leader-boards. Information available to a non-player interface may or may not be also visible in an entertainment game user interface.

In numerous embodiments, sponsors can interact with a multilayer hybrid game by utilizing the non-player interface. The non-player interface can communicate information generated by the sponsor at the non-player interface to a multilayer module that coordinates activities of a multilayer hybrid game. The non-player interface can also communicate any information relevant to sponsored multilayer gameplay to a sponsor that utilizes the non-player interface such as but not limited to players that can be sponsored, sponsorship terms, acceptance of sponsorship terms, and information related to the allocation of a payout resulting from sponsored gameplay. In certain embodiments, sponsors can access any information useful to a sponsor to make sponsorship decisions on a non-player interface, such as (but not limited to) player ratings, gameplay history, and/or player rankings from sponsorable player profiles.

Figure 2:
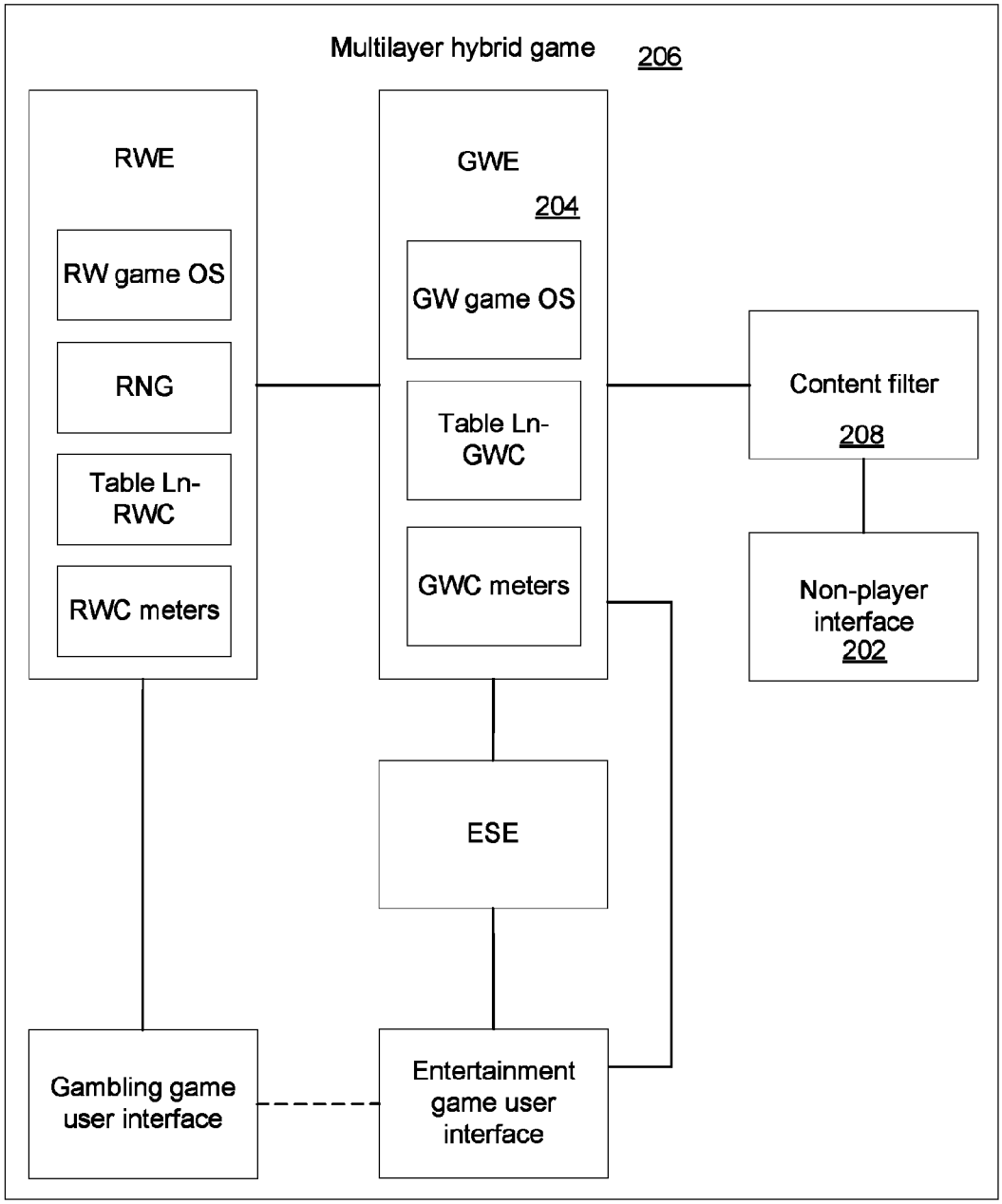
FIG. 2 illustrates a multilayer hybrid game with a non-player interface in accordance with an embodiment of the invention.

A multilayer hybrid game utilizing a non-player interface is illustrated in FIG. 2. The non-player interface 202 communicates with the GWE 204 of a multilayer hybrid game 206 to display information relating to entertainment gameplay or any other information concerning a multilayer hybrid game through a content filter 208. The content filter can determine what information is accessible to the non-player interface 202, such as (but not limited to) whether the non-player interface 202 can see the gameplay progress of all or only some of the players, or whether the non-player interface presents certain information concerning player profiles in accordance with permissions set by a player associated with the player profile or an operator of the multilayer hybrid game (such as but not limited to) a casino that hosts the multilayer hybrid game.

Although various components of multilayer hybrid games are discussed above, multilayer hybrid games can be configured with any component appropriate to the requirements of a specific application in accordance with embodiments of the invention. Network connected multilayer hybrid games are discussed below.

Network Connected Multilayer Hybrid Games

Multilayer hybrid games in accordance with many embodiments of the invention can operate locally while being network connected to draw services from remote locations or to communicate with other multilayer hybrid games. In many embodiments, operations associated with a multilayer hybrid game such as (but not limited to) processes for calculating score or RWC and GWC tracking can be performed across multiple devices. These multiple devices can be implemented using a single server or a plurality of servers such that a multilayer hybrid game is executed as a system in a virtualized space, such as (but not limited to) where the RWE and GWE are large scale centralized servers "in the cloud" coupled to a plurality of widely distributed ESE controllers or clients via the Internet.

In many embodiments, an RWE server can perform certain functionalities of a RWE of a multilayer hybrid game. In certain embodiments, a RWE server includes a centralized odds engine which can generate random outcomes (such as but not limited to win/loss outcomes) for a gambling game, thereby eliminating the need to have that functionality of the RWE performed locally within the multilayer hybrid game. The RWE server can perform a number of simultaneous or pseudo-simultaneous runs in order to generate random outcomes for a variety of odds percentages that one or more networked multilayer hybrid games may require. In certain embodiments, an RWE of a multilayer hybrid game can send information to a RWE server including (but not limited to) Table Ln-RWC tables, maximum speed of play for a gambling game, gambling game monetary denominations or any promotional RWC provided by the operator of the multilayer hybrid game. In particular embodiments, a RWE server can send information to a RWE of a multilayer hybrid game including (but not limited to) RWC used in the gambling game, player profile information or play activity and a profile associated with a player.

In several embodiments, a GWE server can perform the functionality of the GWE across various multilayer hybrid games. These functionalities can include (but are not limited to) providing a method for monitoring high scores on select groups of games, coordinating interactions between gameplay layers, linking groups of games in order to join them in head-to-head tournaments, and acting as a tournament manager. A multilayer module can execute as part of a GWE server to coordinate the gameplay impact from player actions applied to player and/or player classes at various gameplay layers within a multilayer hybrid game.

In a variety of embodiments, management of player profile information can be performed by a GWE patron management server separate from a GWE server. A GWE patron management server can manage information related to a player profile, including (but not limited to) data concerning players' characters, players' game scores, players' RWC and GWC and managing tournament reservations. Although a GWE patron management server is discussed separate from a GWE server, in certain embodiments a GWE server also performs the functions of a GWE patron management server. In certain embodiments, a GWE of a multilayer hybrid game can send information to a GW patron management server including (but not limited to) GWC and RWC used in a game, player profile information, play activity and profile information for players and synchronization information between a gambling game and an entertainment game or other aspects of a multilayer hybrid game. In particular embodiments, a GW patron management server can send information to a GWE of a multilayer hybrid game including (but not limited to) entertainment game title and type, tournament information, Table Ln-GWC tables, special offers, character or profile setup and synchronization information between a gambling game and an entertainment game or other aspects of a multilayer hybrid game. A multilayer module can execute as part of a GWE patron management server to coordinate the gameplay impact from player actions applied to players and/or player classes at various gameplay layers within a multilayer hybrid game.

In numerous embodiments, an ESE server provides a host for managing head-to-head play, operating on the network of ESEs which are connected to the ESE server by providing an environment where players can compete directly with one another and interact with other players. Although an ESE server is discussed separate from a GWE server, in certain embodiments a GWE server also performs the functions of an ESE server.

In several embodiments, a multilayer server can be connected with a multilayer hybrid game and can implement a multilayer module to coordinate the activities of a multilayer hybrid game. A multilayer module can execute as part of a multilayer server to coordinate the gameplay impact from player actions applied to players and/or player classes at various gameplay layers within a multilayer hybrid game. In numerous embodiments, a multilayer server can be part of a distributed system where processes of a multilayer server occur across different multilayer servers of a multilayer server system.

Servers connected via a network to implement multilayer hybrid games in accordance with many embodiments of the invention can communicate with each other to provide services utilized within a multilayer hybrid game. In several embodiments a RWE server can communicate with a GWE server. A RWE server can communicate with a GWE server to communicate any type of information as appropriate for a specific application, including (but not limited to): configure the various simultaneous or pseudo simultaneous odds engines executing in parallel within the RWE to accomplish the multilayer hybrid game system requirements, determine metrics of RWE performance such as random executions run and outcomes for tracking system performance, perform audits, provide operator reports, and request the results of a random run win/loss result for use of function operating within the GWE (such as where automatic drawings for prizes are a function of ESE performance).

In several embodiments a GWE server can communicate with an ESE server. A GWE server can communicate with an ESE server to communicate any type of information as appropriate for a specific application, including (but not limited to): the management of an ESE server by a GWE server such as the management of a multilayer hybrid game tournament. Typically a GWE (such as a GWE that runs within a multilayer hybrid game or on a GWE server) is not aware of the relationship of itself to the rest of a tournament since in a typical configuration the actual tournament play is managed by the ESE server. Therefore, management of a multilayer hybrid game tournament can include (but is not limited to) tasks such as: conducting tournaments according to system programming that can be coordinated by an operator of the multilayer hybrid game; allowing entry of a particular player into a tournament; communicating the number of players in a tournament and the status of the tournament (such as but not limited to the amount of surviving players, their status within the game, time remaining on the tournament); communicating the status of an ESE contained in a game; communicating the performance of its players within the tournament; communicating the scores of the various members in the tournament; and providing a synchronizing link to connect the GWEs in a tournament, with their respective ESE's.

In several embodiments a GWE server can communicate with a GW patron server. A GWE server can communicate with a GW patron server to communicate any type of information as appropriate for a specific application, including (but not limited to) information for configuring tournaments according to system programming conducted by an operator of a multilayer hybrid game, exchange of data necessary to link a player's player profile to their ability to participate in various forms of sponsored gameplay (such as but not limited to the difficulty of play set by the GWE server or the GWE in the game they are playing on), determining a player's ability to participate in a tournament as a function of a player's characteristics (such as but not limited to a player's gaming prowess or other metrics used for tournament screening), configuring the game contained GWE and ESE performance to suit preferences of a player on a particular multilayer hybrid game, as recorded in their player profile, determining a player's play and gambling performance for the purposes of marketing intelligence, and logging secondary drawing awards, tournament prizes, RWC and GWC into the player profile.

In many embodiments, the actual location of where various algorithms and functions are executed may be located either in the game contained devices (RWE, GWE, ESE), on the servers (RWE server, GWE server, or ESE server), or a combination of both. In particular embodiments, certain functions of a RWE server, GWE server, GW patron server or ESE server may operate on the local RWE, GWE or ESE contained with a multilayer hybrid game locally. In certain embodiments, a server is a server system including a plurality of servers, where software may be run on one or more physical devices. Similarly, in particular embodiments, multiple servers may be combined on a single physical device.

Figure 3:
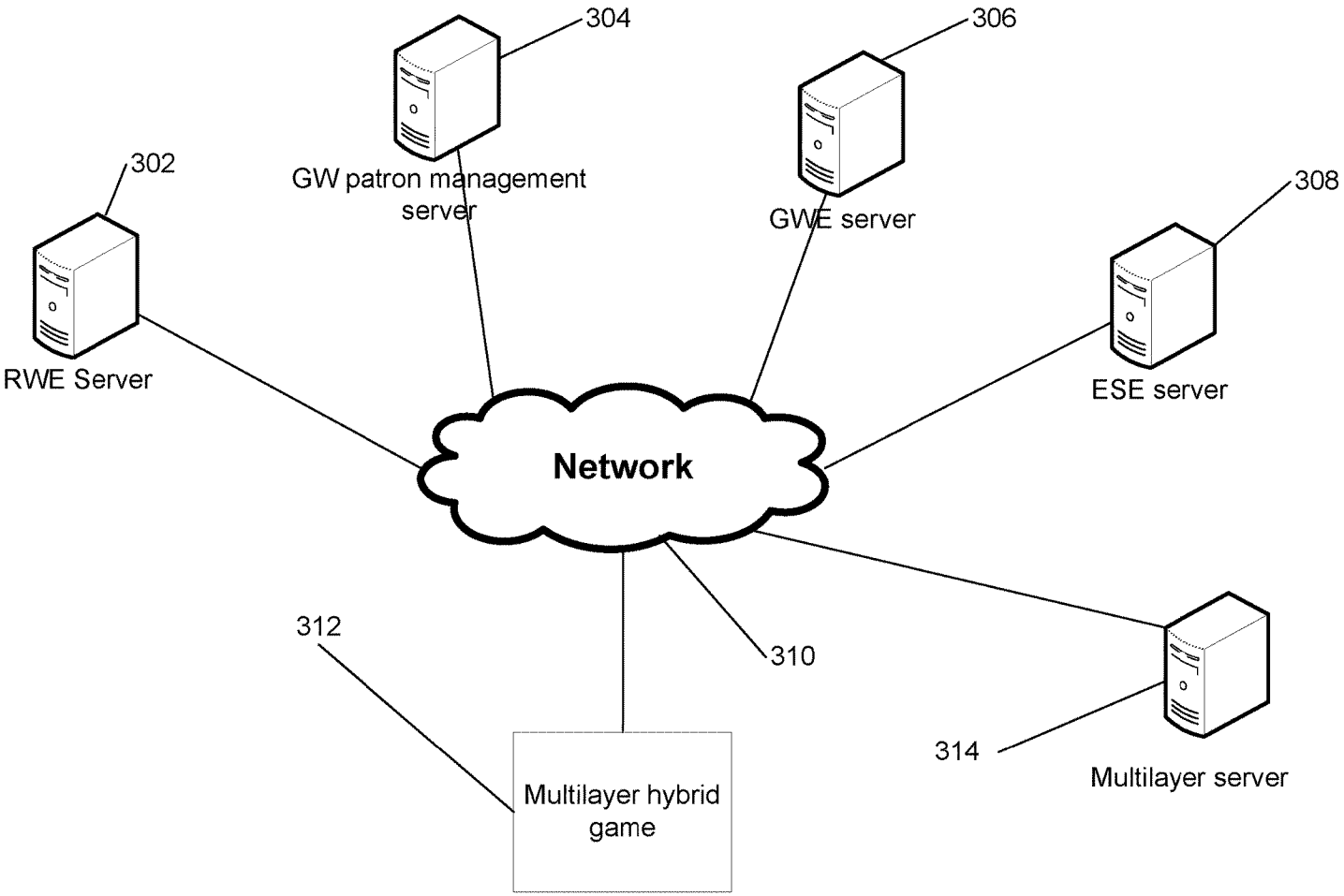
FIG. 3 is a system diagram that illustrates a network distributed multilayer hybrid game in accordance with an embodiment of the invention.

Multilayer hybrid games in accordance with many embodiments of the invention can be networked with remote servers in various configurations. A networked multilayer hybrid game in accordance with an embodiment of the invention is illustrated in FIG. 3. The networked multilayer hybrid game 312 is connected with a RWE server 302, GW patron management server 304, GWE server 306, ESE server 308 and a multilayer server 314 over a network 310, such as (but not limited to) the Internet. Servers networked with a networked multilayer hybrid game 312 can also communicate with each of the components of a networked multilayer hybrid game and amongst the other servers in communication with the networked multilayer hybrid game 312.

Although various networked multilayer hybrid games are discussed above, networked multilayer hybrid games can be configured in any manner as appropriate to the requirements of a specific application in accordance with embodiments of the invention. Multilayer modules that can coordinate the gameplay impact from player actions applied to players and/or player classes at various gameplay layers within a multilayer hybrid game are discussed below.

Multilayer Modules

Figure 4:
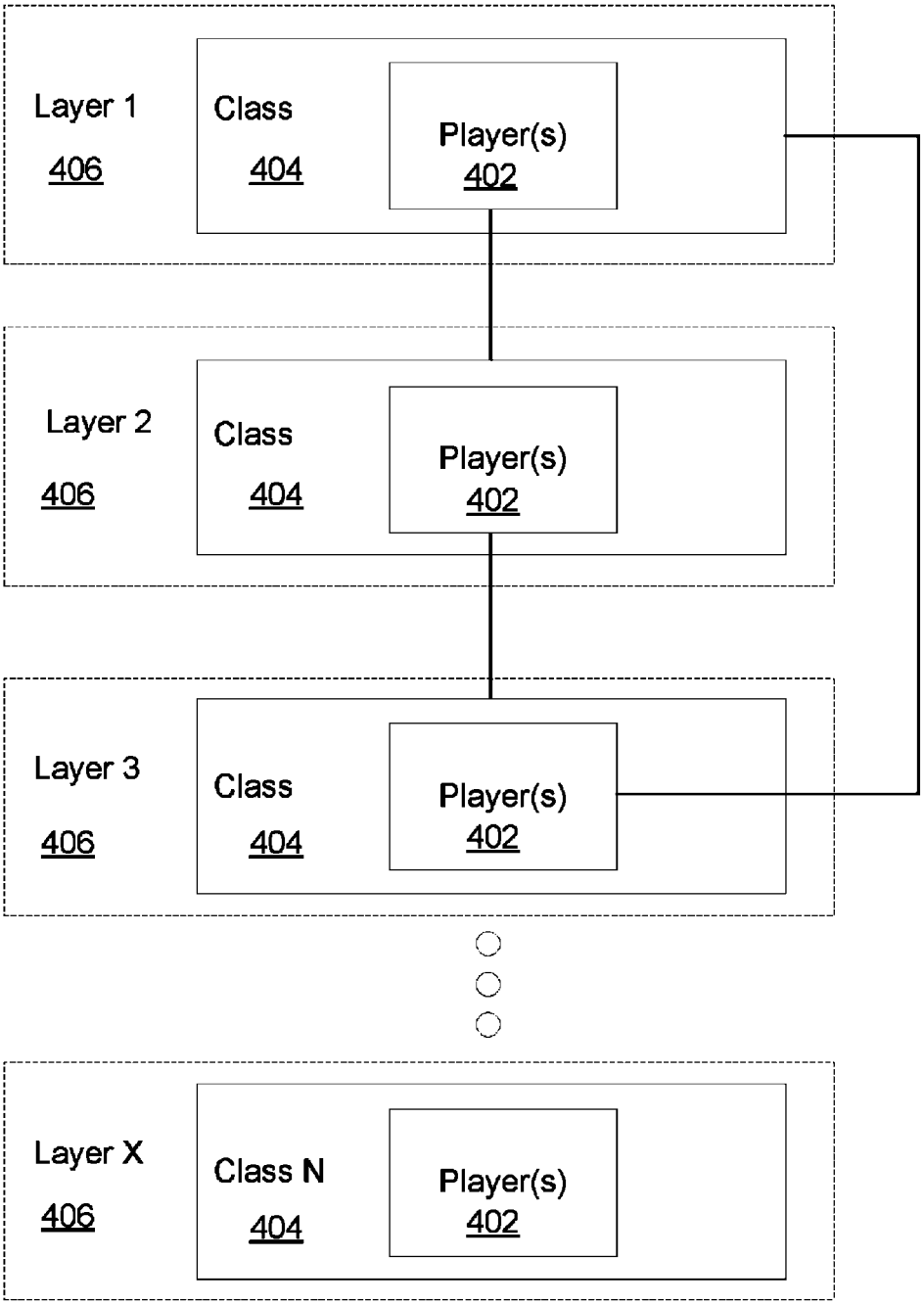
FIG. 4 is a conceptual diagram that illustrates a general relationship among players, player classes, and gameplay layers in accordance with an embodiment of the invention.
Figure 5:
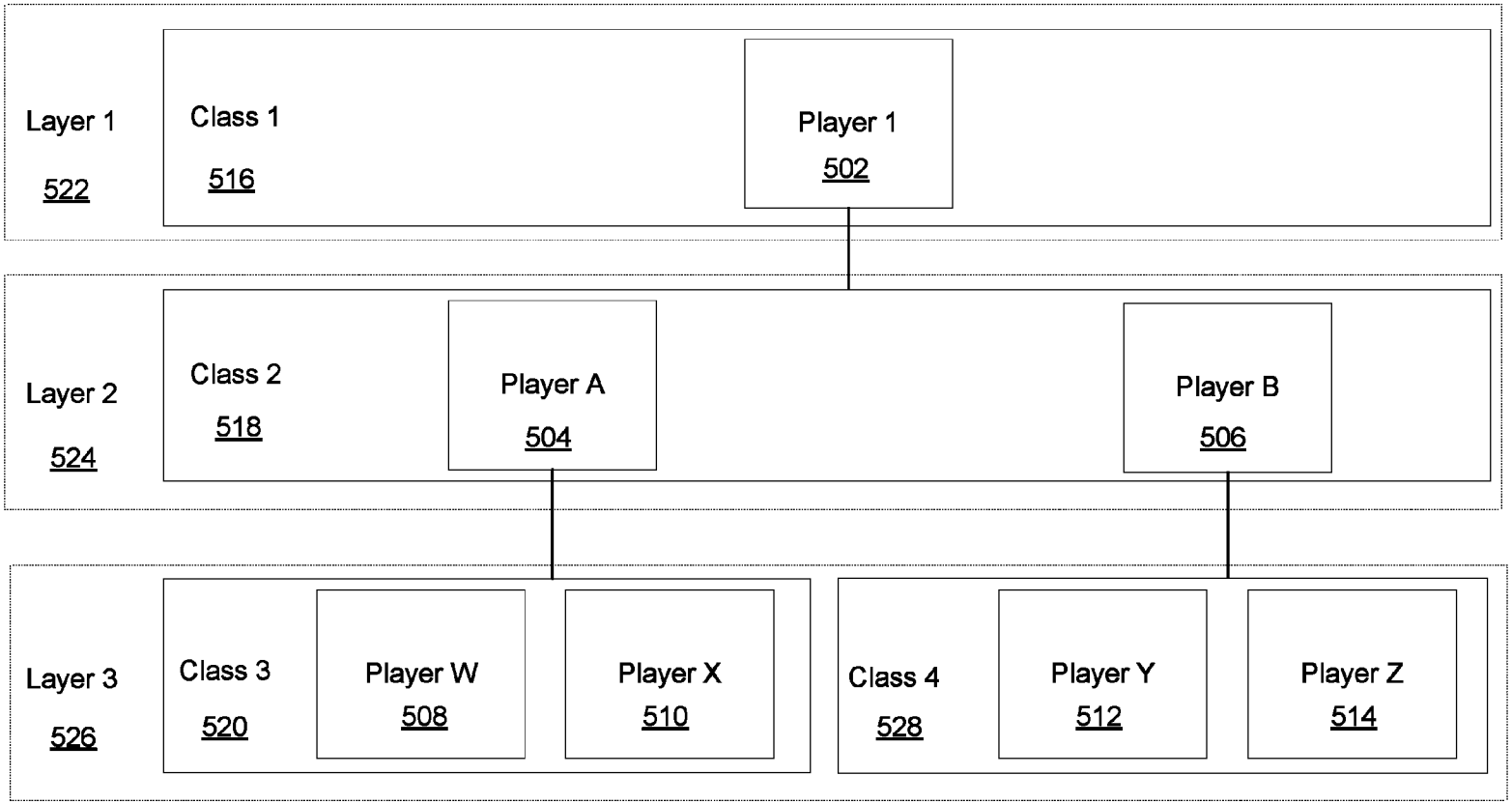
FIG. 5 is a conceptual diagram that illustrates specific relationships among players in four player classes across three gameplay layers in accordance with an embodiment of the invention.

Multilayer hybrid gameplay in accordance with many embodiments of the invention subsumes the idea that a game can include a strategic and a tactical element where, in the context of a consistent game experience, a tactical game for one player can operate in the context of another player's strategic game. A multilayer module can subsume the strategic and tactical elements of gameplay by coordinating the gameplay impact from player actions applied to player classes at various gameplay layers within a multilayer hybrid game. Gameplay impact can be applied according to gameplay impact rules which can be used to analyze a player action to determine the gameplay impact generated and how the gameplay impact is to be applied. A conceptual diagram that illustrates a relationship among players, player classes, and gameplay layers in accordance with an embodiment of the invention is illustrated in FIG. 4. The conceptual diagram of the multilayer hybrid game illustrates that at least one player 402 is part of a class 404 in each gameplay layer 406. A player action in one gameplay level can impact players and/or player classes in any number of other gameplay levels. A conceptual diagram that illustrates a specific relationship of FIG. 4 in accordance with an embodiment of the invention is illustrated in FIG. 5. The conceptual diagram illustrates relationships among players in four player classes across three gameplay layers. Player actions from player one 502 in class one 516 of gameplay layer one 522 can generate a gameplay impact that is applied to player A 504 and player B 506 of class two 518 in gameplay layer two 524. Player actions from player A 504 can generate a gameplay impact that is applied to player W 508 and player X 510 of class three 520 in gameplay layer three 526. Similarly, player actions from player B 506 can generate a gameplay impact that is applied to player Y 512 and player Z 514 of class four 528 in gameplay layer three 526. Gameplay impact can be applied according to gameplay impact rules which can be used to analyze a player action to determine the gameplay impact generated and how the gameplay impact is to be applied. Therefore, as illustrated in FIGS. 4 and 5, the players in each layer can engage in coordinated gameplay across the multiple players in multiple classes within multiple layers by utilizing a multilayer module that coordinates the gameplay impact from player actions applied to the player classes at the various gameplay layers within the multilayer hybrid game according to gameplay impact rules.

Figure 6:
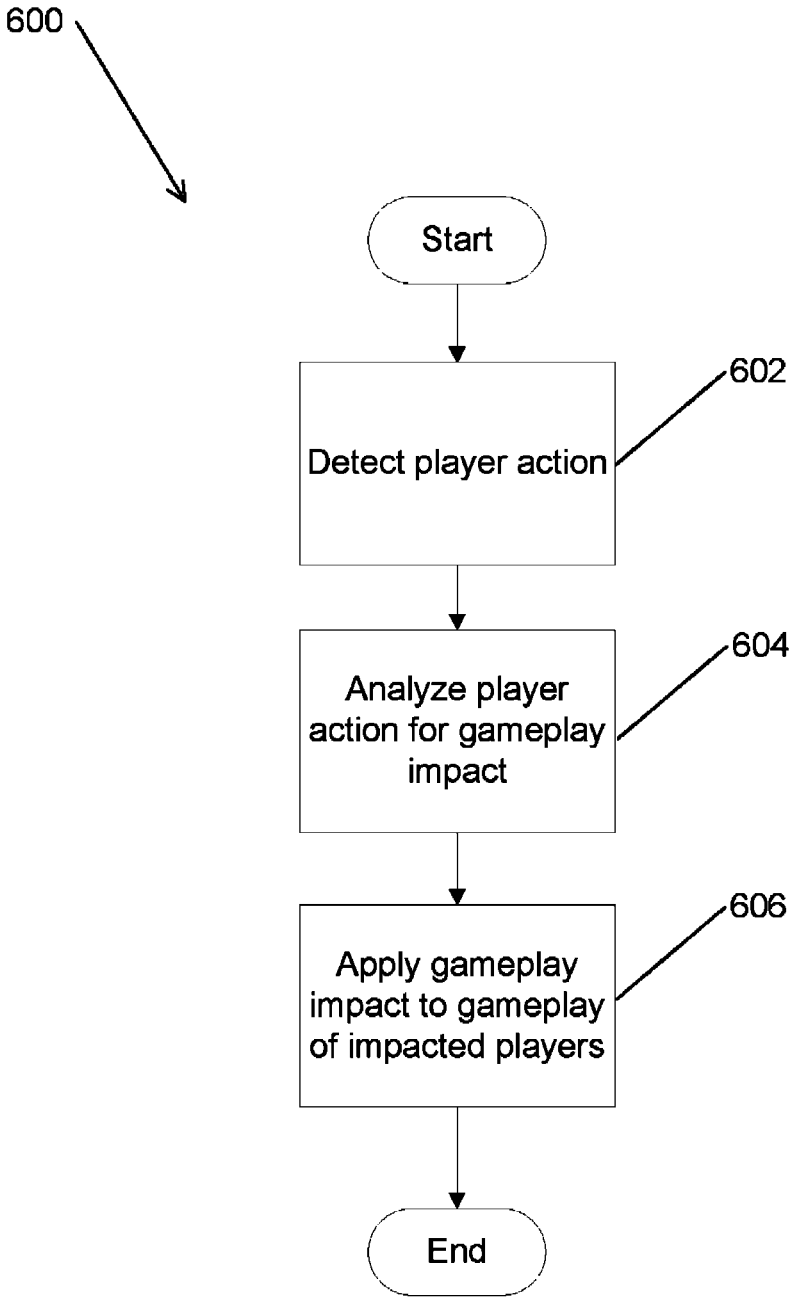
FIG. 6 is a flow chart of a process for applying a gameplay impact to the gameplay of various player classes based upon a specific player action within a specific gameplay level in accordance with an embodiment of the invention.

Multilayer hybrid gameplay in accordance with many embodiments of the invention can utilize a multilayer module to coordinate the interactions between players at different gameplay layers by applying gameplay impacts from player actions to different player classes according to gameplay impact rules defined within a multilayer hybrid game. In numerous embodiments, a multilayer module can be implemented locally on a multilayer hybrid game within the GWE, remotely on a multilayer server accessible to a multilayer hybrid game via a network or as a distributed system where processes of a multilayer module occur locally on a multilayer hybrid game and on a remote server. A flow chart of a process for applying a gameplay impact based upon a player action to the gameplay of a player class in accordance with gameplay impact rules in an embodiment of the invention is illustrated in FIG. 6. The process 600 includes detecting (602) at least one player action ascribed to a player from the player's interaction with gameplay at a gameplay layer. The process also includes determining (604) a gameplay impact from the at least one player action that affects a player and/or player class encompassing at least one player at a different gameplay layer. The gameplay impact can be applied (606) to the player and/or player class to affect the gameplay of each player in the player class.

For example, in an embodiment including a World War II (WWII) themed multilayer hybrid game, a strategic game can be played by one or more players acting as generals, mustering troops and drawing up battle plans, and then launching various attacks or defensive maneuvers. In a single layer game, the strategists' actions are interpreted by the ESE, and based on the ESE software, and to varying degrees based upon RWE outcomes, are distilled into intermediate and ultimately final results. In a multilayer hybrid game, the gameplay impact from player actions of players at a higher level gameplay layer are applied to lower level gameplay layer players who themselves are playing the multilayer hybrid game at a gameplay layer that takes as inputs not only the actions of these lower level players but also the application of gameplay impact from player actions (which includes initial conditions as well as intermediate input throughout the game) from players at a higher level gameplay layer (i.e. higher layer of abstraction, such as a general in the WWII themed multilayer hybrid game). Thereby, player actions from a player with a role as a general can generate a gameplay impact applied to one or more players with a battalion leader role, and/or one or more players with a rank and file soldier role.

Although numerous constructions of a multilayer hybrid game are discussed above, a multilayer hybrid game can utilize a multilayer module in any manner as appropriate to the requirements of a specific application in accordance with embodiments of the invention. A discussion of gameplay impact applied within a multilayer hybrid game is discussed further below.

Gameplay Impact

Multilayer hybrid games in accordance with many embodiments of the invention can utilize a multilayer module to apply gameplay impact based upon at least one player action to players in various classes across different gameplay layers. In many embodiments, gameplay impact can be applied as downward impact from player actions at a higher level gameplay layer to players at a lower level gameplay layer. In certain embodiments, a lower level gameplay layer is a gameplay layer that supports a greater number of players relative to the number of players supported within a particular gameplay layer. In an embodiment including a WWII themed multilayer hybrid game, a player at a high level gameplay layer with a role as a general can generate player actions that can have an impact for players at lower level gameplay layers, such as a battalion leader. Similarly, the player at the intermediate gameplay layer with a role as a battalion leader can generate player actions that have an impact for players at still lower level gameplay layers, such as players at a gameplay layer where the players have roles as rank and file soldiers.

In numerous embodiments, gameplay impact can be applied according to gameplay impact rules which can be used to analyze a player action to determine the gameplay impact generated and how the gameplay impact is to be applied. A gameplay impact rule can trigger the generation and application of a gameplay impact upon detecting at least one player action at a particular gameplay level. The at least one player action can be a single player action or a sequence of player actions which can be detected to trigger application of a gameplay impact, such as but not limited to a winning player action or a sequence of player actions that unlocks an advantageous gameplay impact to be applied to specific players at particular gameplay layers.

In a number of embodiments, gameplay impact can be applied as upward impact from player actions at a lower level gameplay layer to players at a higher level gameplay layer. In certain embodiments, a higher level gameplay layer is a gameplay layer that supports a lower number of players relative to the number of players supported within a particular gameplay layer. In an embodiment including a WWII themed multilayer hybrid game, a player at a lower level gameplay layer with a role as rank and file soldiers can generate player actions that can have an impact for players at higher level gameplay layers, with roles such as a battalion leader or general.

In several embodiments, gameplay impact can be applied as both downward and upward impact. In an embodiment including a WWII themed multilayer hybrid game, a player at a gameplay layer with a role as a battalion leader soldiers can generate player actions that can have an impact for players at higher level gameplay layers, with roles such as a general and an impact for players at lower level gameplay layers, with roles such as a rank and file soldier. In certain embodiments, gameplay impact (upwards or downwards) can be applied simultaneously such as where the player actions of players with roles as rank and file soldiers generate gameplay impact that is applied in real time to the players with roles as battalion leaders while the players with roles as battalion leaders generate gameplay impact that is applied in real time to the players with roles as rank and file soldiers. Furthermore, gameplay impact can be applied to players in player classes at gameplay layers more than one level higher or one level lower.

Although numerous constructions of a multilayer hybrid game are discussed above, a multilayer hybrid game can utilize a multilayer module to apply gameplay impact in any manner as appropriate to the requirements of a specific application in accordance with embodiments of the invention. A discussion of gameplay within a multilayer hybrid game is discussed further below.

Multilayer Hybrid Game Gameplay

In many embodiments, the relationships between players of a multilayer hybrid game can be interrelated such that player actions from each player indirectly affect the gameplay of each other player in a cyclical manner. These relationships can reflect scenarios in various multilayer hybrid games, including in a geopolitical war themed multilayer hybrid game. In an embodiment with a geopolitical war themed multilayer hybrid game, the highest level gameplay layer with the most strategic and abstract type of entertainment game can include players acting as leaders of individual countries. These world leader players can make decisions that impact the production of military goods, the availability of fuel, and the development of new technology. The EE utilized in this gameplay layer might be money, such as but not limited to virtual dollars, spent by the national leader players to build their war economies. The amount of EE will increase or decrease as a function of both play within the entertainment game as well as a results of gambling games initiated through the consumption of EE.

Within an embodiment with a geopolitical war based entertainment game, as a given nation state expands its war-time economy, the amount of munitions available to players serving as generals in a lower level gameplay layer can expand or decrease according to the performance of the player in the higher level gameplay layer (such as the leader of an individual country). The player actions indicative of poor performance can generate a gameplay impact applied to players at a lower level gameplay layer where gameplay resources, such as munitions/EE, are contracted to reflect the player actions indicative of poor performance. Similarly, player actions indicative of good performance can generate a gameplay impact applied to players at a lower level gameplay layer where gameplay resources, such as munitions/EE, are increased to reflect the player actions indicative of good performance, such as but not limited to a player action that is a winning player action which defeats an opponent or otherwise generates a positive result, such as improving the player's wartime economy.

Figure 7:
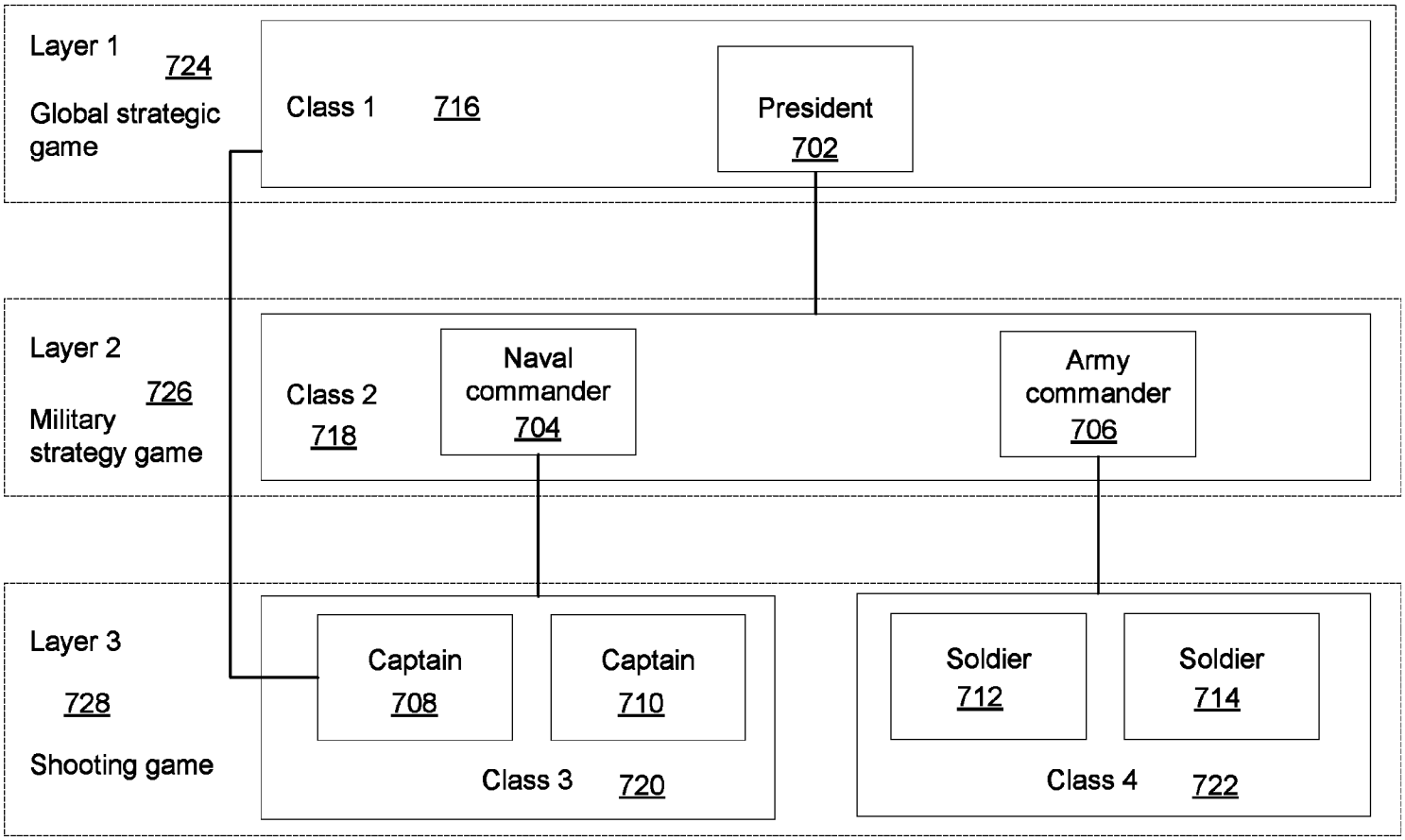
FIG. 7 is a conceptual diagram that illustrates the relationships of FIG. 5 in the context of a war type of multilayer hybrid game in accordance with an embodiment of the invention.

A conceptual diagram that illustrates the relationships of players in a war themed multilayer hybrid game in accordance with an embodiment of the invention is illustrated in FIG. 7. The diagram illustrates a player with a role as a commander-in-chief/president 702 in class one 716 within gameplay layer one 724 that implements a global strategic type of entertainment game, players with roles as a naval commander 704 and an army commander 706 in class two 718 within gameplay layer two 726 that implements a military strategy entertainment game. The diagram also illustrates players with roles as ship captains 708, 710 in class three 720 and players with roles as soldiers 712, 714 in class four 722 where class three 720 players and class four 722 players are within gameplay layer three 728 that implements a shooting type of entertainment game. Player actions performed by the class one player, which is the president 702, can generate a gameplay impact that is applied to the class two players including the naval commander 704 and the army commander 706. Player actions performed by the naval commander 704 can generate a gameplay impact that is applied to the class three players including the two ship captains 708, 710. Player actions performed by the army commander 706 can generate a gameplay impact that is applied to the class four players including the two rank and file soldiers 712, 714. Player actions performed by a captain 708 can generate a gameplay impact that is applied to the class one player, namely the president 702.

Figure 8:
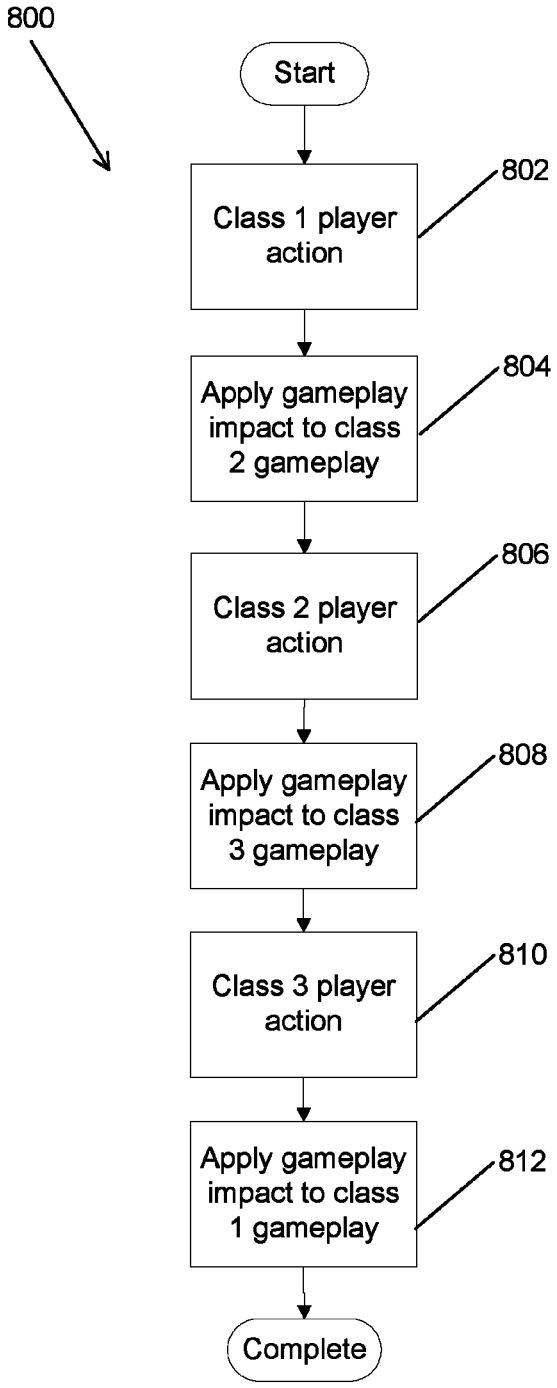
FIG. 8 is a flow chart of a process illustrating how player actions can affect gameplay of classes of players in the various gameplay levels illustrated in FIG. 7 in accordance with an embodiment of the invention.

A flow chart of a process illustrating how player actions can affect gameplay of classes of players in the various gameplay levels illustrated in FIG. 7 in accordance with an embodiment of the invention is illustrated in FIG. 8. The process 800 includes detecting (802) a class one player, such as the president, performing a player action. The player action from the president can be a choice from an option to order a military attack on a number of targets, such as a walled city or a tropical island. The gameplay impact resulting from a player action to attack a particular target is then applied (804) to the gameplay of the class two players, such as a naval commander in a military strategy gameplay layer. The gameplay impact can be applied as limiting the class two players to attack the target, such as a tropical island, elected by the class one player. In many embodiments, the impact is to select the next mission for the class two players and/or define the terrain experienced during the mission. A class two player action can be detected (806) as a particular attack from a choice to make the attack in a number of ways, such as an ambush or an open attack. The gameplay impact resulting from the player action of the class two player, such as an open attack on the tropical island, is then applied (808) to the gameplay of the class three players, such as a ship captain, that limits the class three players to attack the target elected by the class one player in the way elected by the class two player. A class three player action can be detected (810) as a particular attack from a number of ways of making an attack, such as by utilizing firearms or a ship's cannon. The class three player action can be analyzed to determine a gameplay impact applied (812) to class 1 gameplay of the class one player, such as a payout of gameplay resources as economic tribute due to a player action that is a winning action, such as utilizing a ship's cannon in a shot that kills an opponent. On the other hand, the gameplay impact can be negative if the player action is a losing player action, such as a missed shot from the ship's cannon that can result in a reprisal counterattack, which generates a gameplay impact that negatively affects gameplay resources.

Figure 9:
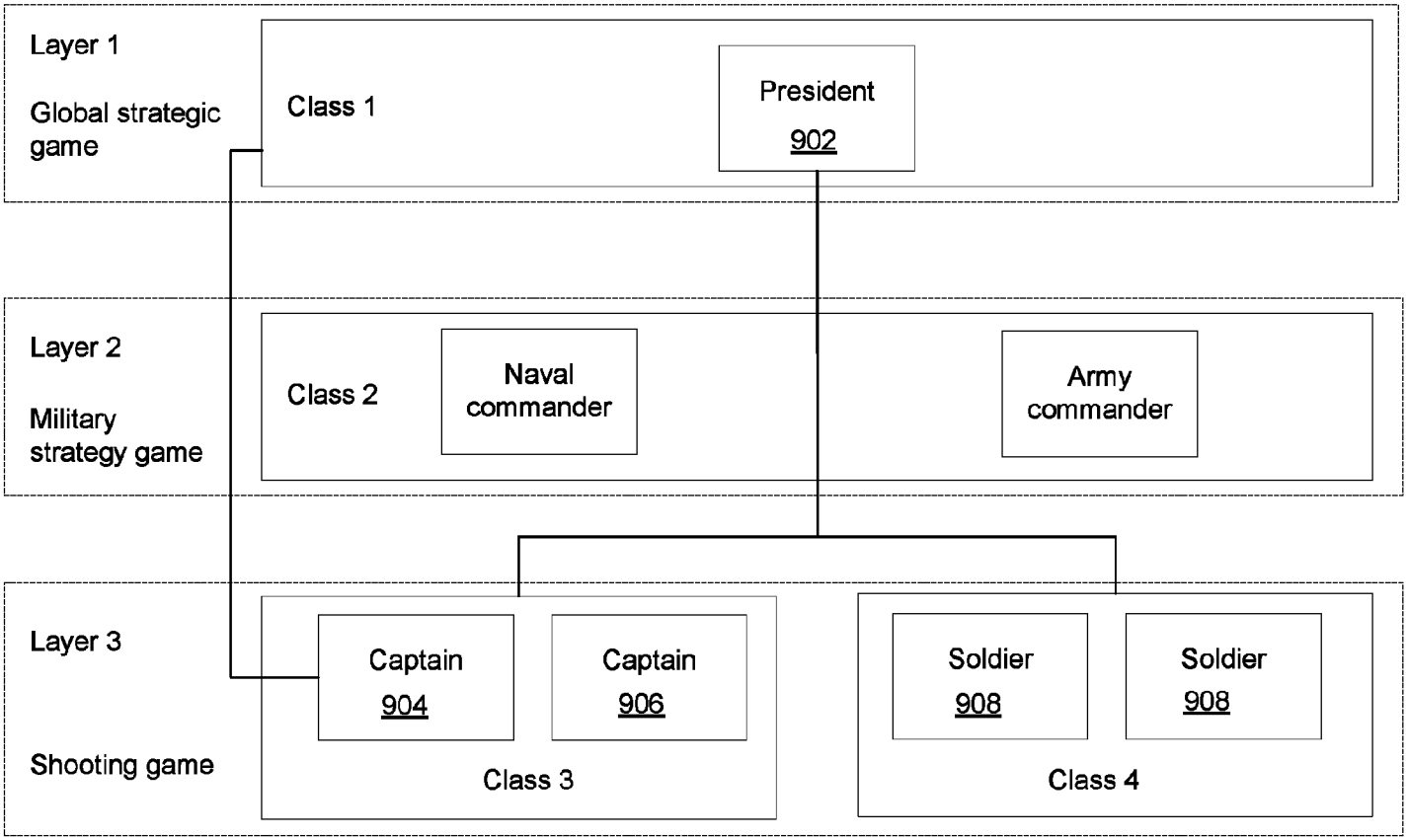
FIG. 9 is a conceptual diagram that illustrates a war type of multilayer hybrid game in which a gameplay impact from a class 1 player action is directly applied to class 3 gameplay in accordance with an embodiment of the invention.
Figure 10:
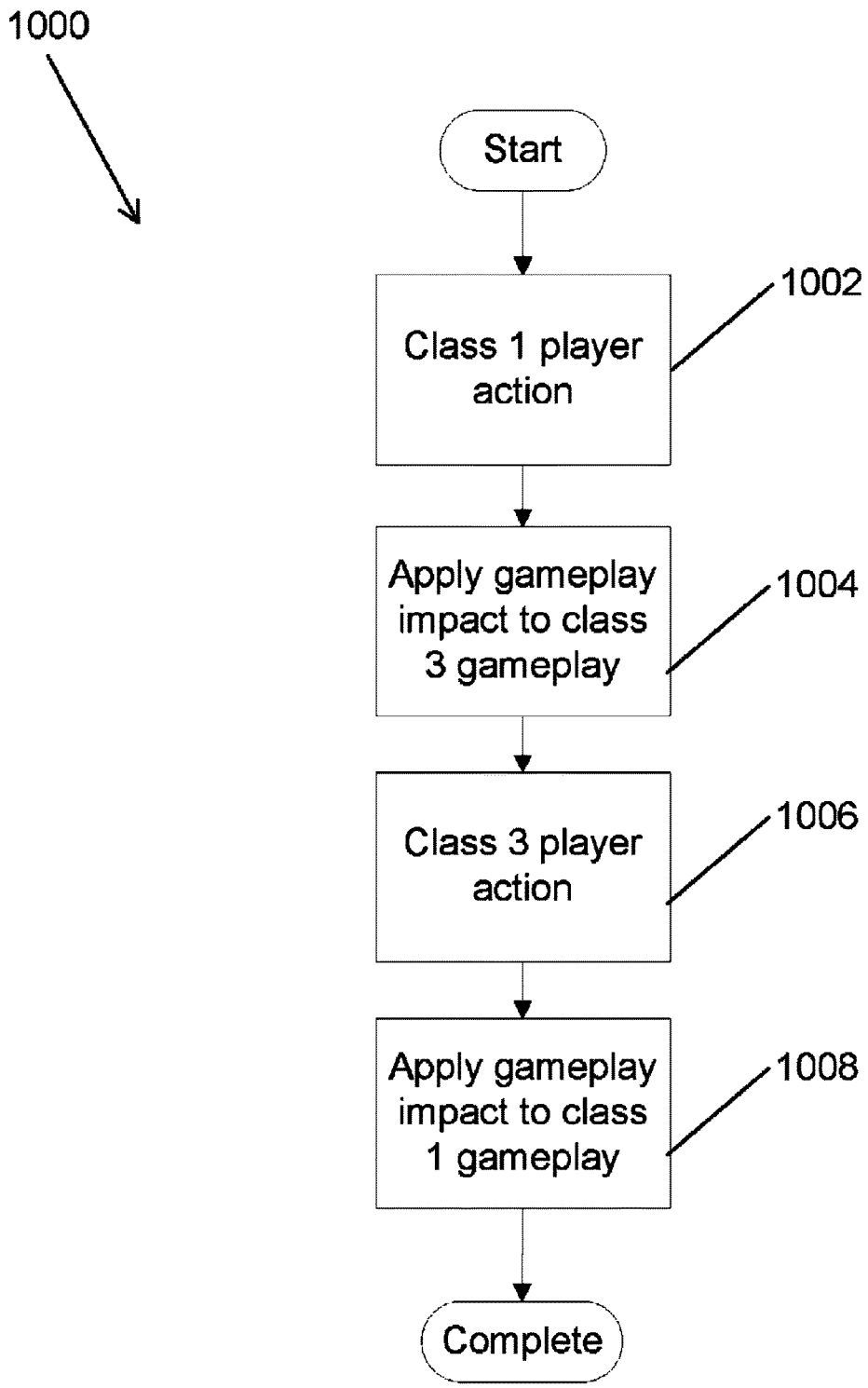
FIG. 10 is a flow chart of a process illustrating how player actions can affect gameplay of classes of players in the various gameplay levels illustrated in FIG. 9 in accordance with an embodiment of the invention.

In many embodiments, a gameplay impact can be applied to players that are not in adjacent gameplay layers. A conceptual diagram that illustrates the war themed multilayer hybrid game of FIG. 7 in which class 3 gameplay is applied with a gameplay impact generated from a class 1 player action in accordance with an embodiment of the invention is illustrated in FIG. 9. The conceptual diagram illustrates that the gameplay impact resulting from player actions from the class 1 player, the president 902, is directly applied to the class 3 and class 4 players, the captains 904, 906 and the soldiers 908, without being first applied to the class 2 players in accordance with particular gameplay impact rules. The diagram also illustrates that the gameplay impact resulting from player actions from a captain 904 of the class 3 players can be applied to the gameplay of the class 1 player, the president 902. A flow chart of a process illustrating how player actions can affect gameplay in the conceptual diagram of FIG. 9 in accordance with an embodiment of the invention is illustrated in FIG. 10. The process 1000 includes detecting (1002) a class 1 player action, such as from a president to change the economic policy of a nation. The gameplay action can yield a gameplay impact of increased access to munitions due to an improved economy from the changed economic policy. The gameplay impact can be applied (1004) directly to the gameplay of the class 3 players, such as by increasing the munitions available to a captain. A player action can be detected (1006) from the captain with increased munitions that is a winning player action, such as an action that defeats an opponent, which generates gameplay impact as a payout of gameplay resources as economic tribute collected from a defeated opponent. A losing player action (1006) can also be detected, such as missing a strike on an opponent that opens the possibility of a reprisal counterattack, which generates a gameplay impact as a reduction in gameplay resources available to a player. The gameplay impact can then be applied (1008) to the class 1 player, the president.

Although various multilayer hybrid games are discussed above, a multilayer hybrid game can be constructed to facilitate gameplay in any way appropriate to the requirements of a specific game theme in accordance with embodiments of the invention. A discussion of multilayer hybrid game themes is discussed below.

Multilayer Hybrid Gameplay Themes

Figure 11:
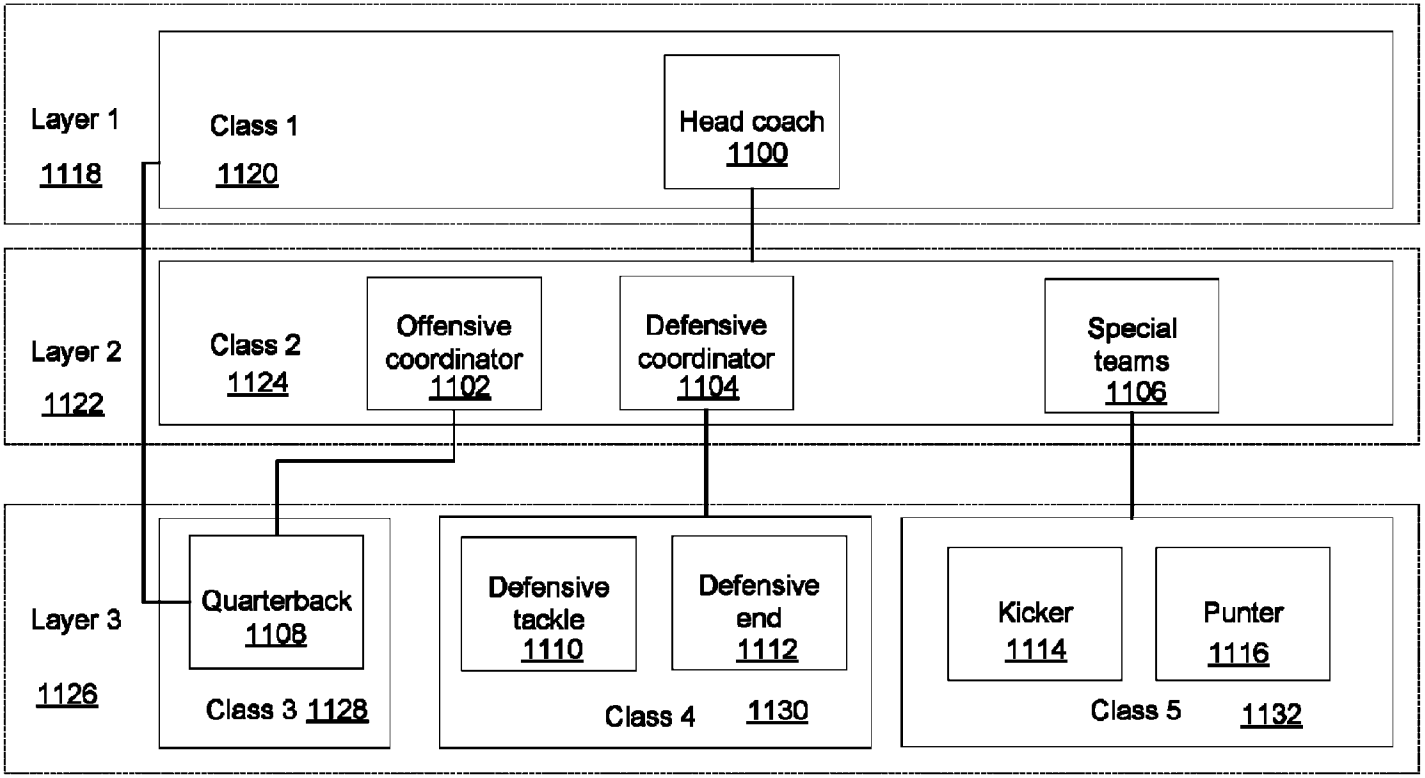
FIG. 11 is a conceptual diagram that illustrates relationships among players and player classes in a football based multilayer hybrid game in accordance with an embodiment of the invention.

Multilayer hybrid games in accordance with many embodiments of the invention can be can be implemented with any gameplay theme as appropriate to the requirements of a specific application, including (but not limited to) a football theme. A conceptual diagram that illustrates relationships among players and player classes in a football themed multilayer hybrid game in accordance with an embodiment of the invention is illustrated in FIG. 11. The conceptual diagram illustrates a player with a role as a head coach 1100 in class one 1120 within a first gameplay layer 1118 and players with roles as an offensive coordinator 1102, defensive coordinator 1104 or special teams manager 1106 in class two 1124 within a second gameplay layer 1122. There is also a third gameplay layer 1126 with a player with a role as a quarterback 1108 in class three 1128, players with roles as a defensive tackle 1110 and defensive end 1112 in class four 1130 and players with roles as a kicker 1114 and punter 1116 in class five 1132. The conceptual diagram also illustrates that the gameplay impact of the head coach's player 1100 actions can be applied to class two players, the gameplay impact of the offensive coordinator's player actions can be applied to the quarterback 1108, the gameplay impact of the defensive coordinator's player actions can be applied to the defensive tackle 1110 and defensive end 1112, the gameplay impact of the special teams manager's player actions can be applied to the kicker 1114 and punter 1116 and that the gameplay impact of the quarterback's player actions can be applied to the head coach 1110.

Figure 12:
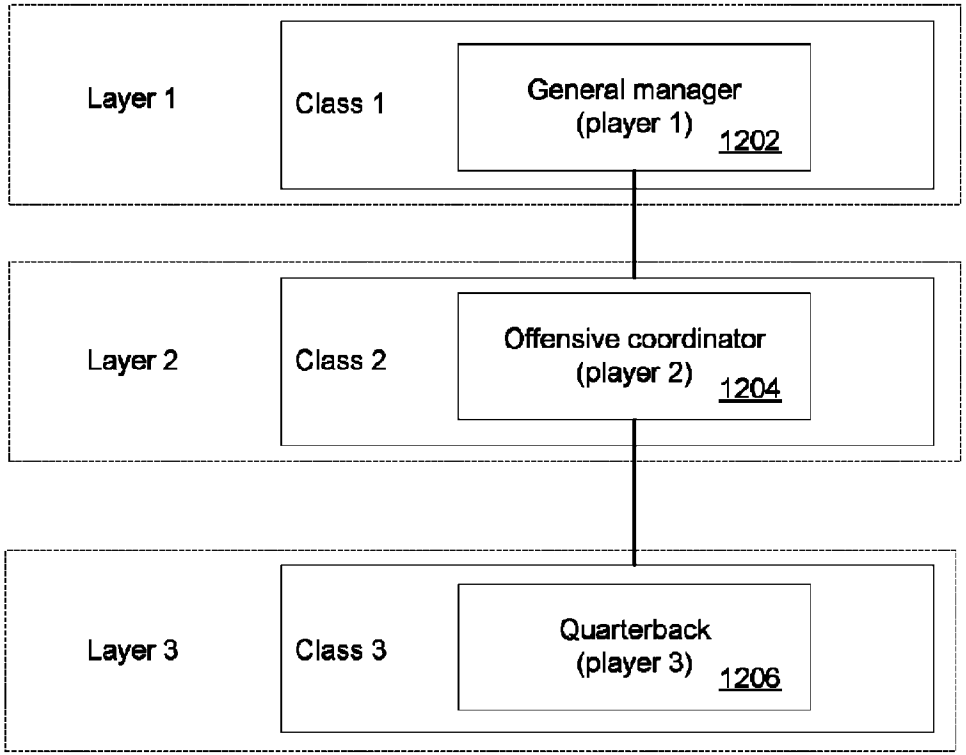
FIG. 12 is a conceptual diagram that illustrates how four players across different classes can collaborate in a gameplay session of a multilayer hybrid game in accordance with an embodiment of the invention.

In many embodiments, a group of players can engage in collaborative or competitive play even if the gameplay layer at which each player is accessing the multilayer hybrid game is different. A conceptual diagram that illustrates how three players across different classes can collaborate in a gameplay session of the football themed multilayer hybrid game of FIG. 11 in accordance with an embodiment of the invention is illustrated in FIG. 12. The players can collaborate as a team where one player is the general manager 1202 (responsible for player personnel decisions), another is the offensive coordinator 1204 (responsible for calling offensive plays) and a third is the quarterback 1206 (responsible for executing the plays called by the offensive coordinator).

Figure 13:
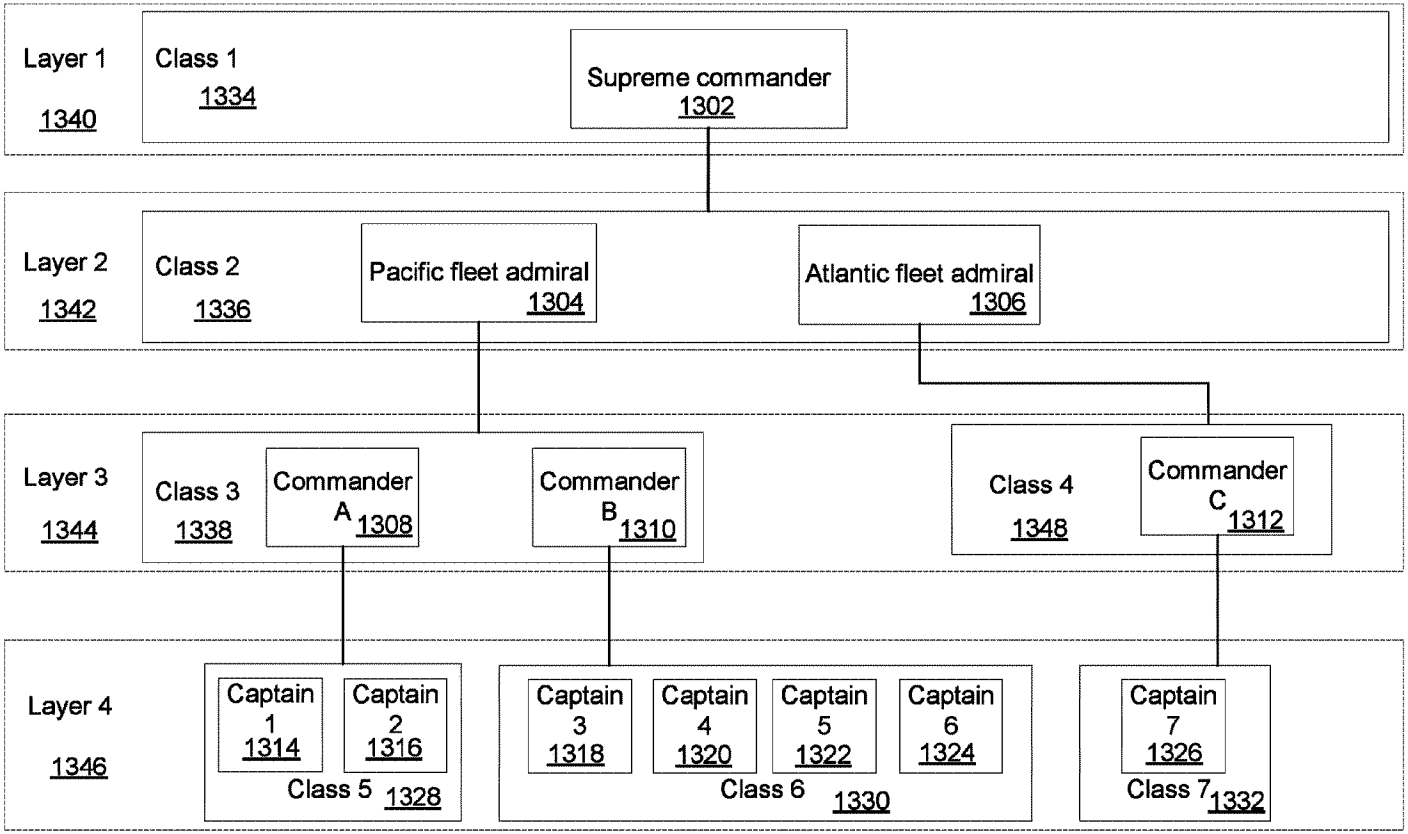
FIG. 13 is a conceptual diagram that illustrates relationships in a World War II (WWII) themed multilayer hybrid game between seven player classes with three player classes engaged in the same gameplay layer in accordance with an embodiment of the invention.

In various embodiments, a gameplay theme that can be implemented in a multilayer hybrid game as naval warfare in WWII. Players with roles as Admirals can command the Japanese and American fleets respectively. Other players with roles as captains of various sea going vessels (e.g. aircraft carriers, submarines, destroyers) can operate their ships under the command of the relevant admiral. Aircraft carriers might then have several dozen players with roles as fighter pilots for their planes. Such a multilayer hybrid game can therefore support simultaneous play by a multitude of players. A conceptual diagram that illustrates relationships in a WWII naval warfare themed multilayer hybrid game between seven player classes in accordance with an embodiment of the invention is illustrated in FIG. 13. The diagram includes a player with a role as the supreme commander 1302 in class one 1334 of gameplay layer one 1340, players with roles as a Pacific fleet admiral 1304 and Atlantic fleet admiral 1306 in class two 1336 of gameplay layer two 1342. Gameplay layer three 1344 can include players with roles as commanders A 1308 and B 1310 in class three 1338 and a player with a role as commander C 1312 in class 4 1348. Gameplay layer four 1346 can include players with roles as a first captain 1314 and a second captain 1316 in class five 1328, players with roles as a third captain 1318, fourth captain 1320, fifth captain 1322 and sixth captain 1324 in class six 1330, and a player with a role as seventh captain 1326 in class seven 1332. Gameplay impact from the supreme commander's player actions can be applied to the class two players, the pacific fleet admiral 1304 and the Atlantic fleet admiral 1306. Gameplay impact from the pacific fleet admiral 1304 can be applied to the class three players, commander A 1308 and commander B 1310. Gameplay impact from the Atlantic fleet admiral's player actions can be applied to the class four player, commander C 1312. Gameplay impact from commander A's player actions can be applied to the class five players, the first captain 1314 and the second captain 1316. Gameplay impact from commander B's player actions can be applied to the class six players, the third captain 1318, fourth captain 1320, fifth captain 1322 and sixth captain 1324. Gameplay impact from commander C's player actions can be applied to the class seven players, the seventh captain 1332.

In numerous embodiments, a car racing gameplay theme can be implemented in a multilayer hybrid game. In certain embodiments with a car racing gameplay theme, one gameplay layer can create a gameplay environment for players with a role of a team owner who can perform player actions such as to select drivers to race for the team owner. The team owner can also perform player actions such as to outfit the drivers with equipment and attempt to secure sponsorship and revenue to fund the team of drivers. The team owner can utilize gameplay resources such as game dollars for EE, with the EE being consumed as a function of investments that the team owner makes in cars, facilities, or personnel. The use of EE in a certain way can trigger gambling games within the multilayer hybrid game. A lower level gameplay layer can provide a gameplay environment for a player with a role of a crew chief with responsibility to tune each race car and coach the driver during the course of each race. The particular race cars and drivers are provided within the gameplay of the crew chief as examples of gameplay impact applied to the crew chief from the player actions of the team owner. Finally, an even lower level gameplay layer can provide a gameplay environment for at least one player with a role as a driver that races the race car in the context provided by the gameplay impact applied to the driver from the player actions made by the team owner and crew chief. The crew chief and driver can each have their standards as to gameplay progression and the utilization of gameplay resources, such as EE and AE, as well as the gambling games that can be triggered by player actions of the crew chief and driver. Gameplay impact can also be applied to the team owner as determined from the player actions of the crew chief or drivers.

In several embodiments, players can elect to play at any given gameplay layer of a multilayer hybrid game at any given time. In certain embodiments, players can opt into different gameplay layers based upon personal preference, such as a personal preference stored in a player profile associated with a player of the multilayer hybrid game. In particular embodiments, certain standards must be met in order for a player to move between certain gameplay layers, such as a standard that requires a certain accumulation of GWE from gameplay in a lower level gameplay layer before moving to a higher level gameplay layer. In certain embodiments, players within a multilayer hybrid game can each enter a gameplay session at the same time or at different times. Players can opt into different gameplay start times based upon personal preference, such as a personal preference stored in a player profile associated with a player of the multilayer hybrid game.

In several embodiments, players of a multilayer hybrid games can make agreements with a recruiting player to enter a gameplay session in exchange for compensation from the recruiting player for participating in the gameplay session. In certain embodiments, a recruiting player at a higher level gameplay layer, such as a player assuming a role as a general, can recruit other players to enter a gameplay session in a lower level gameplay layer, such as to assume a role as a rank and file solder fighting for the general. Potential recruiting players can access the player profiles of potential recruits stored with a multilayer hybrid game, such as within a GWE, GWE server or a patron management server, to evaluate the benefit of recruiting certain players. Also, recruiters can compensate recruits by allocating gameplay resources, such as GWC or RWC, from a player profile associated with a recruiter or gameplay resources provided in the course of gameplay execution to the player profile associated with a recruit. This compensation can take place in the form of sharing a percentage of the recruiter's winnings, allocating GWC (either previously earned or prospectively), direct payment of RWC or GWC or in elements (such as but not limited to EE, or an ancillary item such as a portion, or fuel).

Although various multilayer hybrid games are discussed above, a multilayer hybrid game can be constructed to facilitate multilayer hybrid game themes in any way appropriate to the requirements of a specific game theme in accordance with embodiments of the invention. A discussion of sponsorship in a multilayer hybrid game is discussed below.

Sponsorship in Multilayer Hybrid Games

In many embodiments, a multilayer hybrid game enables players to enter sponsored gameplay with gameplay resources, such as but not limited to RWC, GWC, EE or AE, provided by a third party sponsor in return for the sponsor to receive an allocation of the payout of gameplay resources that result from the sponsored gameplay in accordance with the terms of the sponsorship. Thereby, in certain embodiments, a multilayer hybrid game can enable players to enter sponsored gameplay without utilization of the player's own resources and sponsors to reap a payout of gameplay resources without requiring gameplay participation.

In many embodiments, a sponsorship module coordinates interactions between players and sponsors that enables a player associated with a sponsored player profile to enter sponsored gameplay and allocates payouts of sponsored play according to the terms of the sponsorship accepted by both the sponsor and the player. In numerous embodiments, a sponsorship module can be implemented locally on a multilayer hybrid game within the GWE, remotely on a sponsorship server accessible to a multilayer hybrid game via a network or as a distributed system where processes of a sponsorship module occur locally on a multilayer hybrid game and on a remote server.

In several embodiments, sponsorship terms can encompass any arrangement that allocates gameplay resources among players and sponsors individually or as a group. Sponsorship terms can include (but is not limited to) the provision of RWC, GWC, EE, AE, from one or more sponsors to one or more players in return for an allocation of a payout of RWC, GWC, EE, AE to one or more sponsors. In certain embodiments, sponsorship terms can include the provision of gameplay resources such as (but not limited to) an advantageous celebrity player or an advantageous playing field provided by a sponsor for utilization by a player during sponsored gameplay of a sports type of entertainment game.

In several embodiments, one or more players can engage in sponsored gameplay on a multilayer hybrid game. Sponsored gameplay can be head-to-head or multi-player as a function of the specific multilayer hybrid game in question. Head-to-head sponsored gameplay can be player vs. machine in a single-player mode or multi-player mode, and can also be player vs. machine and/or other player(s) as a function of a specific multilayer hybrid game. Gameplay at other gameplay layers can be modified based on the actions and/or outcomes within the head-to-head play. Also, a player entering sponsored gameplay need not be playing with or against other players that enter gameplay with gameplay resources provided by a sponsor. Numerous examples of sponsorship that can be applied to hybrid games, such as a multilayer hybrid game, is discussed in U.S. Provisional Patent Application No. 61/629,437 filed on Nov. 18, 2011 and Patent Cooperation Treaty Application No. PCT/US12/65937, each disclosure of which is hereby incorporated by reference in its entirety.

Although multiple multilayer hybrid games are discussed above, a multilayer hybrid game can be constructed to facilitate sponsorship in any way as appropriate to the requirements of a specific application in accordance with embodiments of the invention. A discussion of a processing apparatus that can be implemented in a multilayer hybrid game is discussed below.

Processing Apparatus

Figure 14:
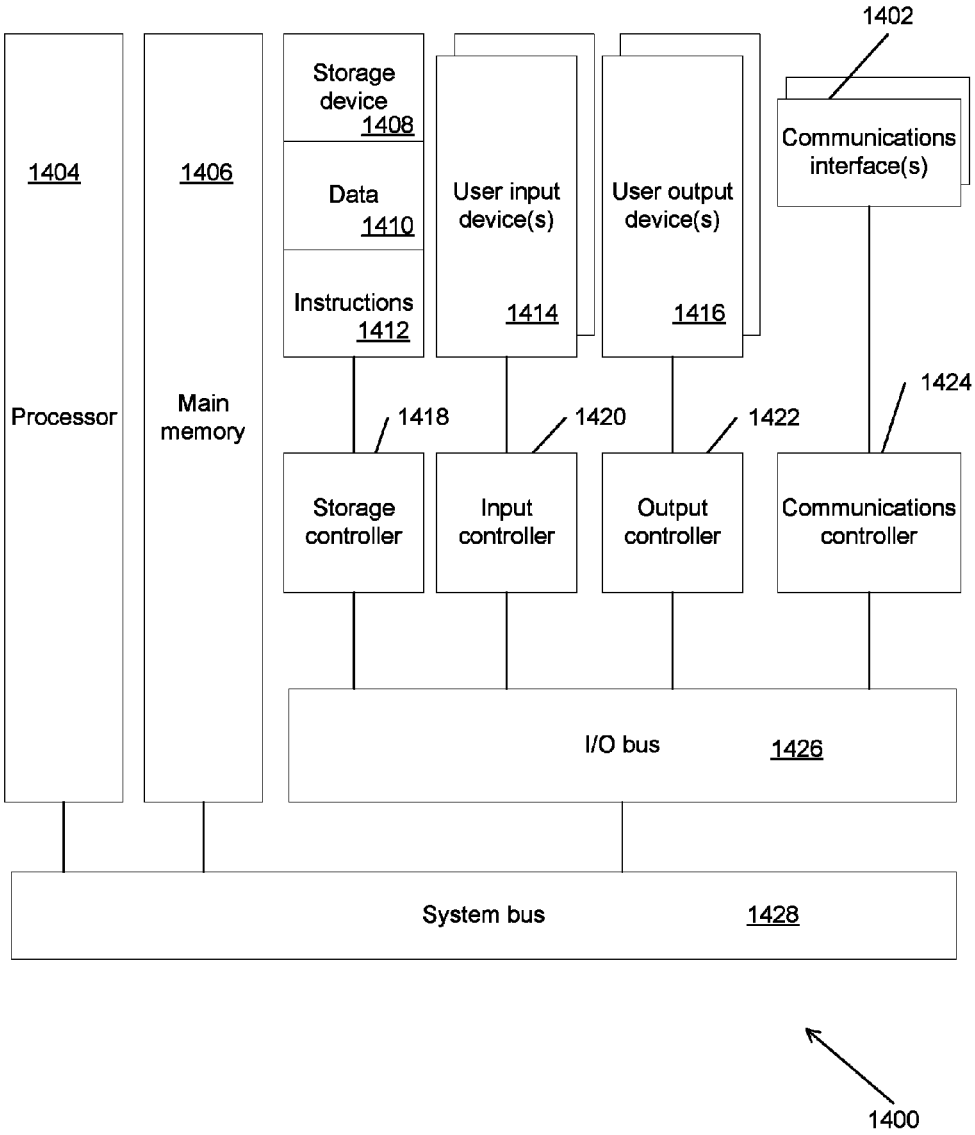
FIG. 14 illustrates a hardware architecture diagram of a processing apparatus utilized in the implementation of a multilayer hybrid game in accordance with an embodiment of the invention.

Any of a variety of processing apparatuses can host various components of a multilayer hybrid game in accordance with embodiments of the invention. In several embodiments, these processing apparatuses can include, but are not limited to, a gaming machine, a general purpose computer, a computing device and/or a controller. A processing apparatus that is constructed to implement a multilayer hybrid game in accordance with an embodiment of the invention is illustrated in FIG. 14. In the processing apparatus 1400, a processor 1404 is coupled to a memory 1406 by a bus 1428. The processor 1404 is also coupled to non-transitory processor-readable storage media, such as a storage device 1408 that stores processor-executable instructions 1412 and data 1410 through the system bus 1428 to an I/O bus 1426 through a storage controller 1418. The processor 1404 is also coupled to one or more interfaces that may be used to connect the processor to other processing apparatuses as well as networks as described herein. The processor 1404 is also coupled via the bus to user input devices 1414, such as tactile devices including but not limited to keyboards, keypads, foot pads, touch screens, and/or trackballs, as well as non-contact devices such as audio input devices, motion sensors and motion capture devices that the processing apparatus may use to receive inputs from a user when the user interacts with the processing apparatus. The processor 1404 is connected to these user input devices 1414 through the system bus 1428, to the I/O bus 1426 and through the input controller 1420. The processor 1404 is also coupled via the bus to user output devices 1416 such as (but not limited to) visual output devices, audio output devices, and/or tactile output devices that the processing apparatus uses to generate outputs perceivable by the user when the user interacts with the processing apparatus. In several embodiments, the processor is coupled to visual output devices such as (but not limited to) display screens, light panels, and/or lighted displays. In a number of embodiments, the processor is coupled to audio output devices such as (but not limited to) speakers, and/or sound amplifiers. In many embodiments, the processor is coupled to tactile output devices like vibrators, and/or manipulators. The processor is connected to output devices from the system bus 1428 to the I/O bus 1426 and through the output controller 1422. The processor 1404 can also be connected to a communications interface 1402 from the system bus 1428 to the I/O bus 1426 through a communications controller 1424.

In various embodiments, a processor loads the instructions and the data from the storage device into the memory and executes the instructions and operates on the data to implement the various aspects and features of the components of a gaming system as described herein. The processor uses the user input devices and the user output devices in accordance with the instructions and the data in order to create and operate user interfaces for players, casino operators, and/or owners as described herein.

Although the processing apparatus is described herein as being constructed from a processor and instructions stored and executed by hardware components, the processing apparatus can be composed of only hardware components in accordance with many embodiments. In addition, although the storage device is described as being coupled to the processor through a bus, those skilled in the art of processing apparatuses will understand that the storage device can include removable media such as but not limited to a USB memory device, an optical CD ROM, magnetic media such as tape and disks. Also, the storage device can be accessed through one of the interfaces or over a network. Furthermore, any of the user input devices or user output devices can be coupled to the processor via one of the interfaces or over a network. In addition, although a single processor is described, those skilled in the art will understand that the processor can be a controller or other computing device or a separate computer as well as be composed of multiple processors or computing devices.

In numerous embodiments, any of an RWE, GWE or ESE as described herein can be implemented on multiple processing apparatuses, whether dedicated, shared or distributed in any combination thereof, or may be implemented on a single processing apparatus. In addition, while certain aspects and features of element management processes described herein have been attributed to an RWE, GWE, or ESE, these aspects and features may be implemented in a hybrid form where any of the features or aspects may be performed by any of a RWE, GWE, ESE within a multilayer hybrid game without deviating from the spirit of the invention.

While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A multilayer gaming system, comprising:

a processor configured as a real world engine connected by a communication link to a processor configured as a game world engine wherein the processor configured as the real world engine comprises:

a real world credit meter;

a random number generator; and a real world credit pay table, wherein the processor configured as the real world engine is configured to:

receive from the processor configured as the game world engine via the communication link, a trigger of a wager of real world credit;

determine a gambling outcome for the wager of real world credit in response to the trigger; and communicate to the processor configured as the game world engine via the communication link, the gambling outcome;

allocate the randomly generated payout of real world credits to the credit meter;

a processor configured as an entertainment software engine connected to the processor configured as the game world engine configured to;

execute a multilayer entertainment game that provides outcomes based upon a plurality of players' skillful execution of the multilayer entertainment game, wherein players at a same gameplay layer are engaged in gameplay subject to the same standards for gameplay progression and utilization of gameplay resources, and wherein impact of an action of a first player at a first gameplay layer on a second player's gameplay in a second gameplay layer are specified by at least one gameplay impact rule;

communicate to the processor configured as the game world engine, the action of the first player;

receive from the processor configured as the game world engine, control information including a second gameplay resource of the second player;

apply a gameplay impact to the gameplay of the second player at the second gameplay layer in accordance with at least one gameplay impact rule, wherein the at least one gameplay impact rule specifies reallocation of the second gameplay resource to the second player's gameplay environment;

generate a user interface display that depicts a representation of the multilayer entertainment game;

the processor configured as the game world engine connected to the processor configured as the entertainment software engine and connected to the processor configured as the real world engine by the communication link wherein the processor configured as the game world engine is configured to:

monitor player actions for a gambling event occurrence where the gambling event occurrence triggers the wager of real world credits;

communicate the trigger to the processor configured as the real world engine via the communication link;

receive from the processor configured as the real world engine via the communication link, the gambling outcome;

generate a multilayer entertainment game impact that can be used to modify the multilayer entertainment game gameplay based a plurality of players' skillful execution of the multilayer entertainment game;

receive from the processor configured as the entertainment software engine, the action of the first player;

detect the action of the first player upon the first gameplay resource responsive to the first player's gameplay within the first gameplay layer of a plurality of gameplay layers;

determine the control information including the second gameplay resource for the second player at the second gameplay layer in response to the detection of the action of the first player upon the first gameplay resource based upon the at least one gameplay impact rule; and a sponsorship module constructed to:

receive from the processor configured as the game world engine a sponsorship term;

communicate to the player the sponsorship term through a user interface;

receive from the user interface acceptance of the sponsorship term;

send the command to execute the multilayer entertainment game based upon the sponsorship term.

2. The multilayer gaming system of claim 1, wherein the sponsorship term determines an allocation of real world credits from sponsored gameplay.

3. The multilayer gaming system of claim 1, wherein the sponsorship term determines an allocation of gameplay resources among a plurality of players' during sponsored gameplay.

4. The multilayer gaming system of claim 1, wherein the sponsorship term creates a head-to-head competition.

5. The multilayer gaming system of claim 4, wherein gameplay at other gameplay layers is modified based on an outcome within the head-to-head competition.

6. The multilayer gaming system of claim 1, wherein the player entering sponsored gameplay does not compete against other players entering sponsored gameplay.

7. The multilayer gaming system of claim 1, wherein the processor configured as the entertainment software engine and the processor configured as the game world engine are constructed from the same device, and wherein the processor configured as the game world engine is operatively connected to the processor configured as the real world engine using a communication link.

8. The multilayer gaming system of claim 1, wherein the processor configured as the real world engine and the processor configured as the game world engine are constructed from the same device, and wherein the processor configured as the game world engine is operatively connected to the processor configured as the entertainment software engine using a communication link.

9. The multilayer gaming system of claim 1, wherein the processor configured as the real world engine, the processor configured as the entertainment software engine, and the processor configured as the game world engine are constructed from the same device.

10. The multilayer gaming system of claim 1, further comprising:

an enclosure constructed to mount:

a user input device operatively connected to the processor configured as the entertainment software engine;

a user output device operatively connected to the processor configured as the entertainment software engine;

a credit input device operatively connected to the processor configured as the real world engine; and a credit output device operatively connected to the processor configured as the real world engine.

11. The multilayer gaming system of claim 10, wherein the processor configured as the real world engine is further constructed to:

communicate with the credit input device to receive a credit input;

credit a credit meter with credits based on the incoming credit data;

execute a wager based on a communication received from the processor configured as the game world engine;

update the credit meter based on a wager outcome of the wager; and communicate with the credit output device to generate a credit output based on credits transferred off of the credit meter.

* * * * *